US011939863B2

(12) United States Patent
Davis et al.

(10) Patent No.: US 11,939,863 B2
(45) Date of Patent: Mar. 26, 2024

(54) DISTRIBUTED ACOUSTIC SENSING SYSTEMS AND METHODS WITH DYNAMIC GAUGE LENGTHS

(71) Applicant: Halliburton Energy Services, Inc., Houston, TX (US)

(72) Inventors: Eric Davis, San Francisco, CA (US); Mikko K. Jaaskelainen, Houston, TX (US); Joshua Brandt Stokes, Denver, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 196 days.

(21) Appl. No.: 17/492,097

(22) Filed: Oct. 1, 2021

(65) Prior Publication Data

US 2023/0108047 A1 Apr. 6, 2023

(51) Int. Cl.
*E21B 47/14* (2006.01)
*E21B 49/00* (2006.01)

(52) U.S. Cl.
CPC ..... *E21B 47/14* (2013.01); *E21B 49/003* (2013.01)

(58) Field of Classification Search
CPC ..... E21B 47/14
See application file for complete search history.

(56) References Cited

U.S. PATENT DOCUMENTS

| | | | | |
|---|---|---|---|---|
| 9,702,244 | B2 | 7/2017 | Willis et al. | |
| 10,125,605 | B2 | 11/2018 | Mayerhofer et al. | |
| 10,451,475 | B2 | 10/2019 | Dean et al. | |
| 10,883,861 | B2 | 1/2021 | Farhadiroushan et al. | |
| 2013/0298665 | A1* | 11/2013 | Minchau | E21B 43/26 73/152.51 |
| 2016/0245077 | A1 | 8/2016 | Willis et al. | |
| 2018/0003550 | A1 | 1/2018 | Dean et al. | |
| 2018/0238167 | A1* | 8/2018 | Ravi | G01V 1/226 |
| 2019/0120047 | A1 | 4/2019 | Jin et al. | |
| 2019/0301276 | A1* | 10/2019 | Jin | E21B 47/107 |
| 2020/0063550 | A1 | 2/2020 | Barry et al. | |
| 2021/0285323 | A1 | 9/2021 | Davis et al. | |

OTHER PUBLICATIONS

Foreign Communication from Priority Application—International Search Report and Written Opinion of the International Searching Authority, International Application PCT/US2021/053487, dated Jun. 23, 2022, 13 pages.

Electronic Acknowledgment Receipt, Specification and Drawings for International Application No. PCT/US2021/053487, entitled "Distributed Acoustic Sensing Systems and Methods with Dynamic Gauge Lengths," filed Oct. 5, 2021, 68 pages.

* cited by examiner

*Primary Examiner* — Kristyn A Hall
(74) *Attorney, Agent, or Firm* — Conley Rose, P.C.; Rodney B. Carroll

(57) ABSTRACT

A method includes deploying an optical fiber attached to a distributed acoustic sensing (DAS) interrogator in a wellbore, pre-setting gauge length of the DAS interrogator based on an expected measurement signal, interrogating the optical fiber using the DAS interrogator, receiving reflected DAS signals along a length of the optical fiber using the pre-set gauge length, performing an analysis to estimate a location and a magnitude of a strain source associated with the reflected DAS signals, and dynamically adjusting the gauge length for at least a portion of the optical fiber within a pre-defined limit of the DAS interrogator as a function of the estimated location and magnitude of the strain source to enhance sensitivity and to optimize signal-to-noise ratio.

16 Claims, 15 Drawing Sheets

500A

Sensitivity analysis of 5 m gauge length across time samples in a vertical section of a wellbore

500B

Sensitivity analysis of 15 m gauge length across time samples in a vertical section of a wellbore

700C

Sensitivity analysis of 5 m gauge length across channels in a lateral section of a wellbore

700D

Sensitivity analysis of 15 m gauge length across channels in a lateral section of a wellbore

800

DISTRIBUTED ACOUSTIC SENSING SYSTEMS AND METHODS WITH DYNAMIC GAUGE LENGTHS

TECHNICAL FIELD

The present application relates generally to systems and methods with respect to real-time measurements related to oil and gas exploration based on distributed acoustic sensing (DAS) systems.

BACKGROUND

The DAS systems may employ an optical fiber together with an interrogator deployed in a wellbore to analyze strain measurements. These sensing systems may rely on detecting phase changes in backscattered light signals to determine changes in strain caused by the strain sources along the length of the optical fiber. To measure the phase changes, measurements of light signals from two different points along the optical fiber are taken to determine an average amount of strain over that distance. The distance between these two points may be referred to as the gauge length and is usually fixed for each acquisition period. The gauge length is one of the significant parameters for the DAS systems having a direct impact on ensuing sensitivity, signal-to-noise-ratio (SNR), and spatial resolution of detected DAS data signals.

DAS gauge length trades-off between the location of strain sources and the SNR. Shorter gauge lengths may correspond to lower SNR but better spatial resolution, and thus be more appropriate when the strain sources are close to the fiber and signals are large. Longer gauge lengths may correspond to higher SNR but poorer spatial resolution, and be more appropriate when the strain sources are distant from the optical fiber and the signals are small. Moreover, the use of large gauge lengths may mask signal details that are important for strain analysis. Furthermore, in DAS micro-seismic applications, the fixed gauge length may impact the ability to detect micro-seismic events and well interference pressure measurements that are desirable to identify trends above the noise line and dynamic events on a short time scale. Additionally, in hydraulic fracturing operations, sensing system settings and fracturing parameters may be adjusted on the fly to account for varying signal conditions, where signal strength depends on reservoir characteristics. Accordingly, an ongoing need exists for real-time adjustment of the gauge length to enhance sensitivity and to optimize SNR for both high-frequency DAS micro-seismic signals and low-frequency signals associated with fracture growth.

BRIEF DESCRIPTION OF DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
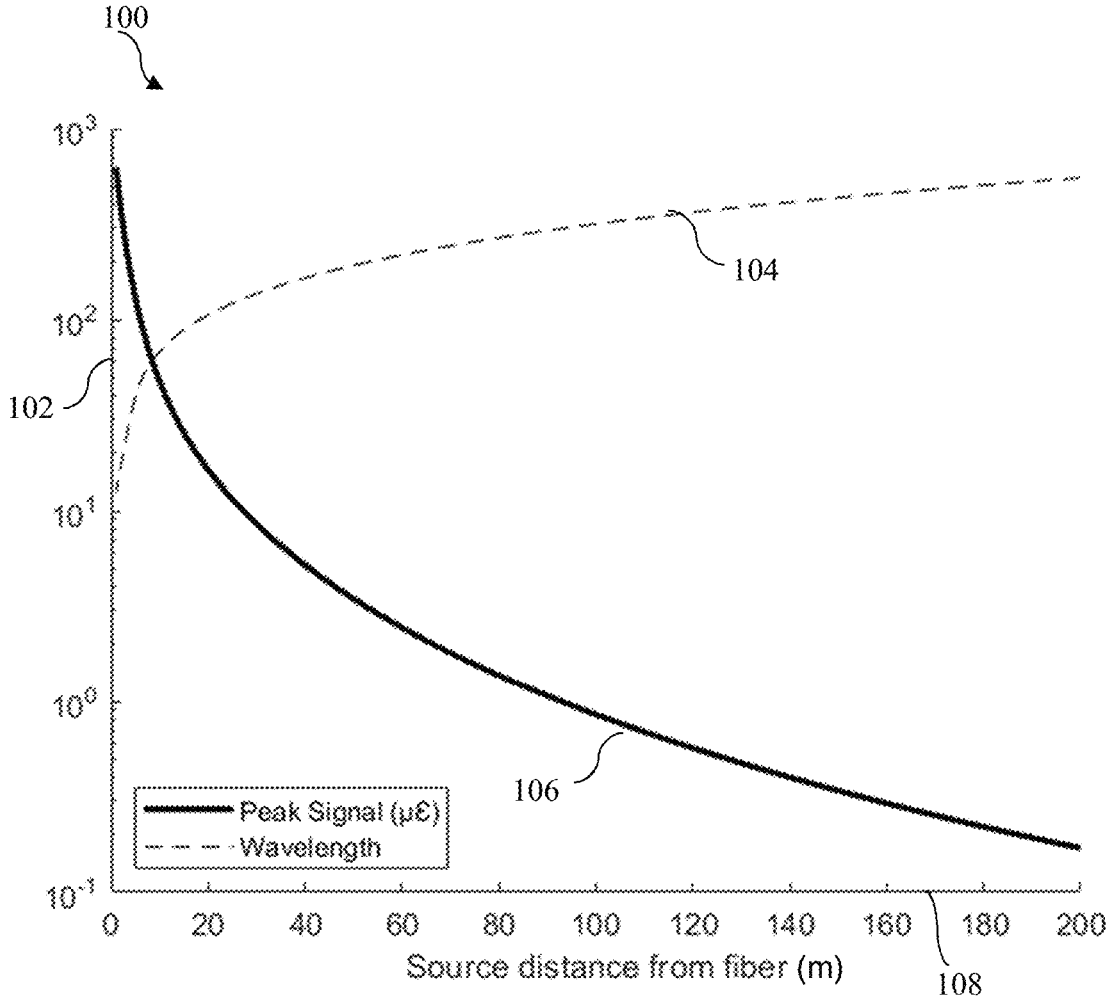
FIG. 1 illustrates a graph as an example of measured amplitude and measured wavelength of strain signals versus strain source distance from an optical fiber, in accordance with embodiments of the present disclosure.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

The present disclosure generally relates to systems and methods for dynamically adjusting a gauge length in a DAS system to enhance sensitivity and to optimize SNR levels of detected DAS data signals in a variety of applications and environments such as micro-seismic sensing applications and hydraulic fracturing environments. The gauge length in the DAS system may vary across time and/or channels (i.e., depths) along the length of an optical fiber to allow optimal sensitivity analysis of the detected DAS data signals in real-time.

As discussed above, perturbations or strains (e.g., caused by strain sources) introduced to the optical fiber at various locations may alter the back propagation of light and those affected light propagations may then provide measurements with respect to the reflected signals that generated the perturbations. The gauge length in the DAS systems may have different effects (e.g., loss of spatial precision associated with longer gauge lengths and noise associated with shorter gauge lengths) on the reflected signals collected by the DAS system. Thus, to address these different effects, the disclosed methods may allow the selection of a desired gauge length that optimizes the collected DAS data during acquisition.

In some embodiments, the DAS system may comprise one or more DAS interrogators and optical fibers. The DAS interrogator may have an internal selection of fixed length optical fibers that are used to generate interference measurements out of the reflected signals returning from an optical fiber under measurement. Each of these optical fibers may be used as an option to adjust the gauge length. Accordingly, to the disclosed methods herein, the DAS interrogator may employ a fiber optic switch to select a desired length optical fiber among the optical fibers for adjusting the gauge length based on the interference measurements and placing the desired gauge length fiber in the measurement circuit. The fiber optic switch may comprise a software-controlled microelectromechanical system (MEMS) device or any other suitable optical switch. Thus, the disclosed methods provide the DAS interrogator to continually switch among a set of gauge lengths in the DAS interrogator during the acquisition to enhance sensitivity and to optimize SNR in real-time.

In some embodiments, in a hydraulic fracturing environment, a hydraulic fracturing process may include pumping a treatment fluid into a wellbore at a known rate through perforations into a subterranean formation. The DAS system may measure data about strain signals generated by the treatment fluid moving through the formation. The methods described herein may employ real-time calculation of positions of the treatment fluid in the formation, which may be used to determine characteristics (e.g., a size and a location) of fractures formed during the hydraulic fracturing process. As an example, use of smaller gauge lengths may allow for more accurate interpretation of the signals (including the location and the size of the fractures/strain sources) when the fractures are close to the fiber and the signals are large. This provides an operator with real-time access to DAS measurements and the ability to adjust DAS system settings and fracturing parameters on the fly to account for varying signal conditions. In this way, employing dynamic gauge length adjustment may enable early signal detection results (e.g., analysis of fluid location) and provide more time for the treatment plan to react to a potential well hit while also potentially enabling monitoring of smaller sources such as production.

In some embodiments, the SNR optimization may include data-driven or machine learning type models for managing multiple sensing systems and data sets in different environments (e.g., regions, basins, reservoirs, layers, drilling info, etc.). The model may predict the DAS signals from an assumed set of hydraulic fractures or strain sources in the formation and use the results to optimize the fracturing parameters. The model may be a machine learning model, a data-driven model, a physics-based model, or a hybrid model.

FIG. 1 is a plot 100 of measured amplitude and measured wavelength of strain signals (or distribution of strain across the optical fiber) versus strain source distance from the optical fiber in a DAS system that provides an example of gauge length effect. The y-axis 102 may represent measured signal wavelength 104 or measured signal amplitude 106, and the x-axis 108 may represent distance of a strain source from the fiber. The graph shows that, as the strain source distance from the fiber increases, the signal amplitude degrades, but the measured signal wavelength (a.k.a spatial distribution of strain across the optical fiber) increases. Thus, the amplitude measured along the length of the optical fiber has a non-linear relationship to the strain source distance from the fiber. However, the measurement of wavelength along the length of the optical fiber has a linear relationship to the strain source distance from the fiber. Thus, the detected wavelength of detected DAS data signals may be selected as a function to choose an optimal gauge length along at least a portion of the fiber to enhance sensitivity and to optimize SNR. In one case, the detected wavelength is the lowest wavelength of the detected DAS data signals along the at least portion of the optical fiber. In one example, according to the embodiments disclosed herein, the gauge length may be adjusted for at least a portion of the optical fiber within a pre-defined limit of a DAS interrogator as a function of the detected wavelength or distribution of data signals collected by the DAS system based on the estimated location and magnitude of the strain source to optimize SNR. Using this method, the small signals from distant sources may be detected and acted upon while increased precision may be obtained for less distant sources.

Figure 2:
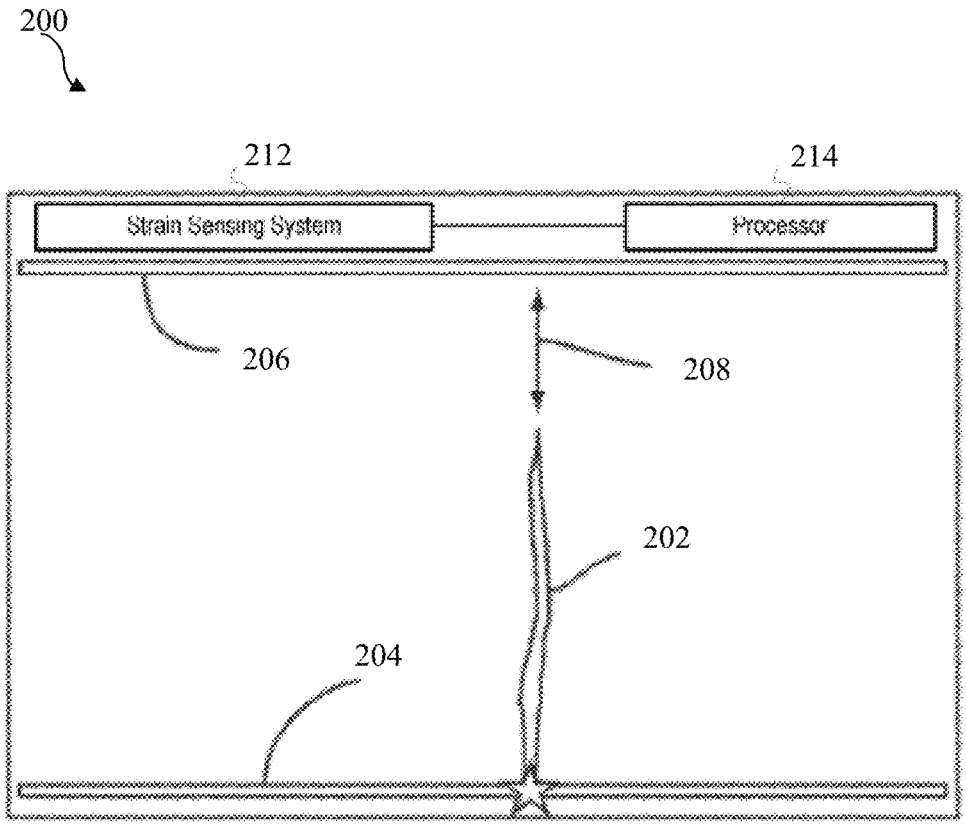
FIG. 2 illustrates a strain observation system and how a single hydraulic fracture might propagate from a treatment well toward the strain observation well, in accordance with embodiments of the present disclosure.

FIG. 2 shows a conceptual sketch 200 of a strain observation setup and a hydraulic fracture 202 propagating from a treatment well 204 towards a strain observation well 206. In one example, during a hydraulic fracturing operation, seismic waves originating from a micro-seismic event may scatter or otherwise affect light pulses traveling within a fiber optic cable and results in the hydraulic fracture 202 within the formation. In another example, in hydraulic fracturing operations, to conduct a fracturing process, pressure is used to pump special fracturing fluids, and at least one perforation is made at a particular down-hole location through the treatment well 204 into a subterranean formation to provide access to the formation for the fracturing fluid. The fracturing fluid enters into the reservoir through perforation clusters, resulting in the hydraulic fracture 202 during the hydraulic fracturing process.

The observation well 206 and the treatment well 204 may run in a vertical direction, horizontal direction, or both to the surface, and the two wellbores (204, 206) may be in proximity and approximately parallel. Distance 208 may be the distance from the observation well 206 to the fracture tip. It should be noted that the terms observation well and treatment well are used for illustrative purposes. Each well may have both treatment and observing capabilities built-in. For purposes of this illustration, the observation well 206 may be equipped with a strain sensing system 212 that provides measurements of strain in DAS signals along the horizontal axis.

The strain sensing system 212 (also can be a micro-seismic sensing system) may comprise a distributed acoustic sensing (DAS) system communicatively coupled to a fiber optic sensing cable for strain sensing and micro-seismic monitoring. The DAS system may comprise a DAS interrogator for interrogating the backscattered light from optical fibers deployed within the fiber optic sensing cable to detect fracture initiation points and fracture growth including orientation and growth rates. FIG. 2 further may further comprise a processor 214 coupled to the DAS interrogator and configured to control the operation of the DAS interrogator. The processor 214 may be programmed to process the information received from DAS data signals and record, display, or transmit distributed axial strain and/or microseismic data needed to determine desired hydraulic fracture system geometry properties. As a result, the processor 214 may be able to estimate real-time data representing the location of the hydraulic fracture 202. Once the location of the hydraulic fracture 202 is determined, the measurements along the fiber optic cable may be used to determine the magnitude of the strain induced by the hydraulic fracture.

As a result, DAS data signals vary as a function of hydraulic fracture location, and the measurements taken along the length of the fiber optic cable in substantially real-time provide valuable data for monitoring the detection of fracture in the offset well. Accordingly, embodiments disclosed herein are directed to collecting the DAS data intermittently across time and/or channels along the length of the fiber optic cable and adjusting the gauge length throughout a fracturing stage to allow the use of sensitivity analysis to optimize the SNR.

Figure 3:
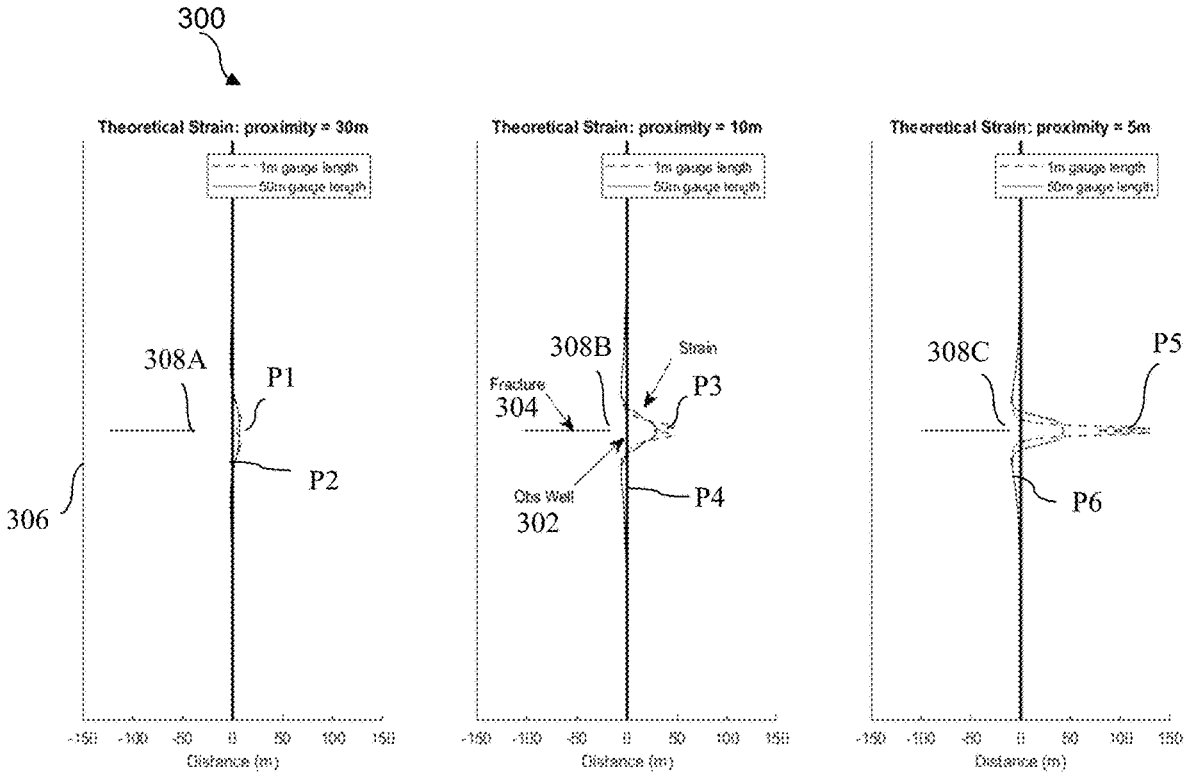
FIG. 3 illustrates plots across an observation well for an illustrative strain source at different distances to an optical fiber using different gauge lengths, in accordance with embodiments of the present disclosure.

FIG. 3 illustrates plots 300 across an observation well 302 for an illustrative hydraulic fracture at different distances to an optical fiber using different gauge lengths, in accordance with embodiments of the present disclosure. The three plots show illustrative reflected DAS signals/strain signals in the observation well for a single hydraulic fracture/strain source 304 from a treatment well 306 and approaching the observation well 302 at a 90-degree angle with different strain proximity values/distances between the hydraulic fracture tip and the observation well 302 at different gauge lengths. In all plots, the y-axis may represent the axial strain measured along the observation well 302, and the x-axis may represent distance in meters (m) from the observation well 302. In the first plot, at a distance of 30 m between the hydraulic fracture tip 308A and the observation well 302, corresponding reflected strain signals for gauge lengths of 1 m (curve P1) and 50 m (curve P2) have been observed to analyze strain measurements. In the second plot, at a distance of 10 m between the hydraulic fracture tip 308B and observation well 302, corresponding reflected strain signals for gauge lengths of 1 m (curve P3) and 50 m (curve P4) have been observed to analyze strain measurements. In the third plot, at a distance of 5 m between the hydraulic fracture tip 308C and the observation well 302, corresponding reflected strain signals for gauge lengths of 1 m (curve P5) and 50 m (curve P6) have been observed to analyze strain measurements.

As can be seen from the plots, the amplitude of reflected strain signals increases significantly and the detected wavelength decreases as the strain source/fracture approaches the observation well 302. The signal from the larger gauge length changes only slightly between the curves P4 and P6, indicating it would be difficult for analysis software to distinguish between the two cases, whereas the signal from the smaller gauge length, shown by the curves P3 and P5, changes dramatically. Thus, use of smaller gauge lengths, when the strain source (i.e. the hydraulic fracture 304) is close to the fiber and the signals are large, may allow for a more accurate interpretation of the signal.

Accordingly, the methods disclosed herein are directed to determine whether DAS signals measured using a specific gauge length provide a sufficient or excessive SNR, and then, accordingly, adjust to that specific gauge length along the length of the fiber in real-time, that results in enhanced sensitivity, SNR, and data quality. The implementation of dynamic gauge length may take place either within the DAS interrogator itself or as part of a separate calculation using an external system/processor as discussed below.

In one case, the implementation of dynamic gauge length may take place on the DAS interrogator itself. In this case, the DAS interrogator may pre-set gauge length based on an expected wavelength of strain signals, an expected strain distribution along the optical fiber, or pre-estimated distance of a strain source from the optical fiber and then, interrogating the optical fiber. Next, the DAS interrogator may interrogate the optical fiber and receive reflected DAS signals associated with the strain source along a length of the optical fiber using the pre-set gauge length. The DAS interrogator may perform an analysis on the reflected DAS signals to determine signal-to-noise ratio of a strain component of the reflected DAS signals and then, dynamically adjust the gauge length for at least a portion of the optical fiber within a pre-defined limit of the DAS interrogator as a function of the signal-to-noise ratio within a pre-defined range. The signal-to-noise ratio calculation may be performed using a low-pass filter or Fast Fourier Transform (FFT).

In another case, the DAS interrogator may be coupled to the processor 214 configured to analyze the reflected DAS signals to estimate the magnitude and wavelength of measured strain signals along the optical fiber. The processor or a separate software may use that information to request a change in gauge length from the DAS interrogator for at least a portion of the optical fiber or whole optical fiber as a function of a distance from the fiber to the closest strain source based on the magnitude and the wavelength of the strain signals to enhance sensitivity and to maximize SNR.

In another case, the DAS interrogator may receive the reflected DAS signals at various times to measure changes (e.g., strain changes) in the optical fiber at various depths. Then, the processor 214 coupled to the DAS interrogator may perform an analysis to estimate a location and a magnitude of a strain source (e.g., hydraulic fracture) associated with the reflected DAS signals, wherein the location means the distance from and/or along the fiber. Then, the DAS interrogator may dynamically adjust the gauge length for at least a portion of the optical fiber within a pre-defined limit as a function of estimated location and magnitude of the strain source(s) to enhance sensitivity and to optimize SNR. In some embodiments, the analysis may be performed using a linear inversion to the measurement signals together with a predictive model of signals from hydraulic fracture growth to estimate the distance of the one or more strain sources from the fiber and/or location along the fiber. The predictive model predicts the DAS signals from an assumed set of hydraulic fractures or strain sources in the formation. The predictive model may be an analytic model or a machine learning based model.

As the locations of strain sources change very slowly compared to the DAS data acquisition rate, the change of gauge length may also occur much more slowly than the acquisition rate. This may allow enough time for a robust calculation of signal and noise levels. In one example, the DAS system may alternate between different gauge lengths in order to e.g. collect DAS data/strain data using one gauge length in time period T1, optionally collect strain data using a second gauge length in time period T2, and then interleave a micro-seismic data collection in time period T3, where the period durations for micro-seismic data collection may be 10 times to 100 times or even 1000 times longer or more frequent than the data collection period for strain sensing data collection. A sequence of data collection may be repeated and optimized during a fracturing operation. As micro-seismic events happen relatively quickly and strain events happen relatively slowly when compared with micro-seismic events, it may be desirable in some cases to collect micro-seismic signals and data with a higher data density in order to capture a larger number of short duration micro-seismic events.

Below are some example graphs of sensitivity analysis of the detected DAS data signals along the length of the optical fiber at each of a series of time samples and/or across channels/depth that may allow for the temporal and spatial quantification of SNR and the identification of changes in strain due to real signals such as an approaching fracture. In some embodiments, the sensitivity of the signal may be described mathematically by setting a sensitivity threshold range (+/−) and statistically evaluating the signal for measurements in excess of the sensitivity threshold range (+/−) across both time samples and channels. Key statistics may include, but are not limited to, the: 1) median excess sensitivity percent per time sample and/or channel; 2) the percent of all time samples and/or channels with excess sensitivity; and 3) the median and standard deviation of cumulative strain per a specified unit time per channel.

In hydraulic fracturing operations, adjusting the gauge length early in the stage may allow the use of sensitivity analysis to maximize the SNR. The increased SNR may allow for improved early detection of approaching fractures and higher resolution for DAS micro-seismic. Once a gauge length has been selected for weak signal detection, it may be maintained until a strain/fracture arrival threshold range (+/−) has been met, or unless the signal to noise increases to a threshold that triggers a reevaluation of the best gauge length. In some embodiments, once the strain/fracture arrival threshold range (+/−) has been met, the gauge length may be reevaluated for sensitivity. The strain/fracture arrival threshold range (+/−) may be focused on the predictable channels (channel range) to help ignore noise that may occur on the fiber due to a relief of strain unrelated to an actual fracture arrival.

In some embodiments, a windowed approach in both time and channels may be utilized to identify the point time when the gauge length should be reevaluated due to the arrival of strain/fracture. Strain/fracture arrival threshold range (+/−) may be calculated by the cumulative positive/negative strain magnitude across the expected arrival channels over a predetermined time window. In some embodiments, multiple windows of time may be evaluated consecutively to ensure the pattern is consistent in time (window threshold). In some embodiments, machine learning (ML) model parameters, such as 1) sensitivity threshold range (+/−), 2) strain/fracture arrival threshold range (+/−), and 3) windowed approach parameters such as a) channel range and b) window threshold, may be learned using data stored from previous stages. Initially, the thresholds and channel ranges may be estimated, but as more data is collected, the parameters may be estimated by software to optimize the timing of switching gauge lengths (e.g., using supervised learning). The strength of allowing the software to make the decisions may be the repeatable decision making allowing for comparable quantifiable analysis.

Figure 4A:
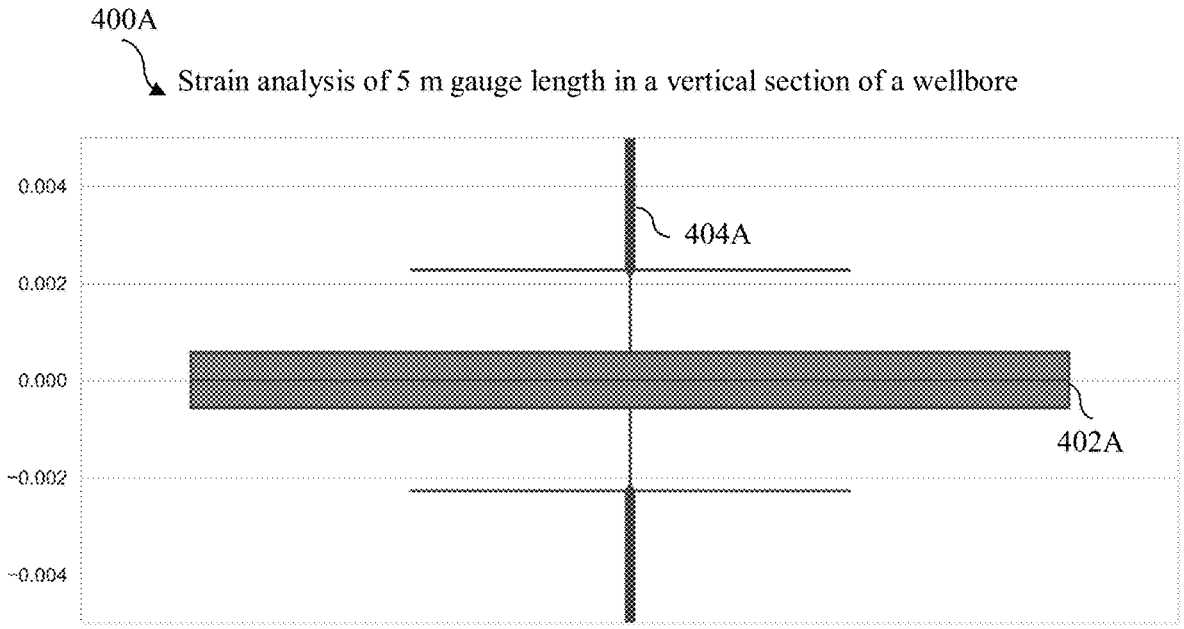
FIGS. 4A-4B illustrate boxplot graphs of strain analysis of detected DAS data signals for different gauge lengths in a vertical section of a wellbore, in accordance with embodiments of the present disclosure.
Figure 4B:
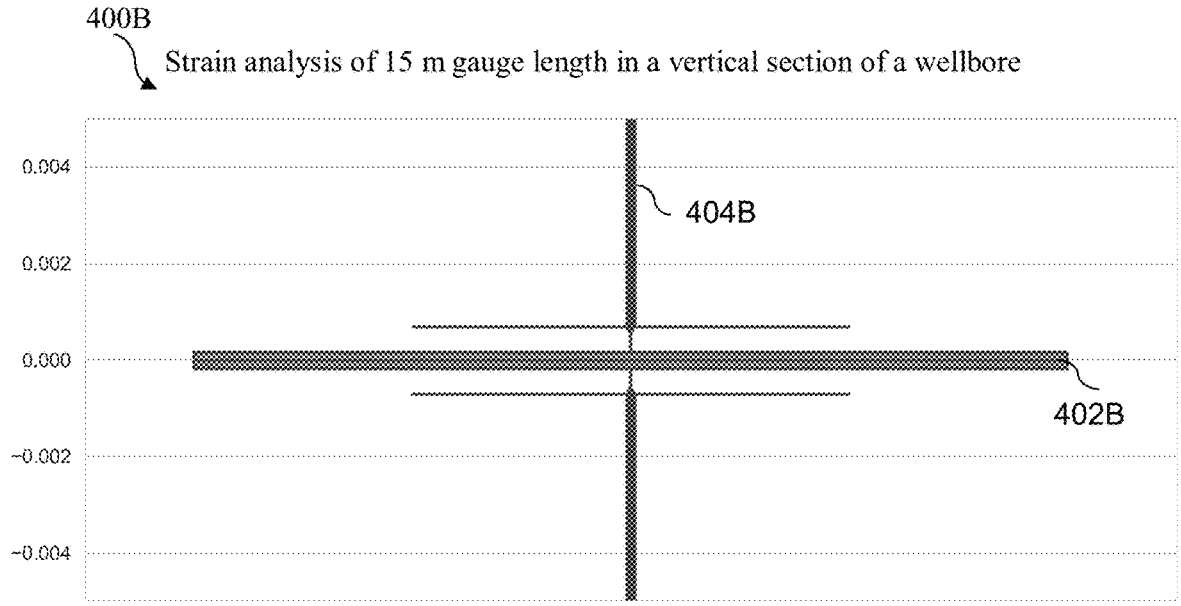

FIGS. 4A-4B illustrate boxplot graphs of strain analysis for different gauge lengths in a vertical section of wellbore, in accordance with embodiments of the present disclosure. FIG. 4A illustrates a boxplot graph 400A of strain analysis resulting using a gauge length of 5 m. In the boxplot, a center 402A may indicate the median value of the strain. The straight lines above and below the box are the measured maximum strain and measured minimum strain values. The strain values that fall out of the minimum bound and maximum bound were identified as outliers 404A. FIG. 4B illustrates a boxplot graph 400B of strain analysis resulting using a gauge length of 15 m. In the boxplot, a center 402B indicates the median value of the strain. The strain values that fall out of the minimum bound and maximum bound were identified as outliers 404B. The median values of the strain may represent actual strain or noise. As can be seen from FIG. 4A and FIG. 4B, in a comparison of the graph 400A (5 m gauge) vs. the graph 400B (15 m gauge), the strain or noise distribution in the graph 400B (15 m gauge) has lower magnitude values and variance as compared to the graph 400A (5 m gauge).

Figure 5A:
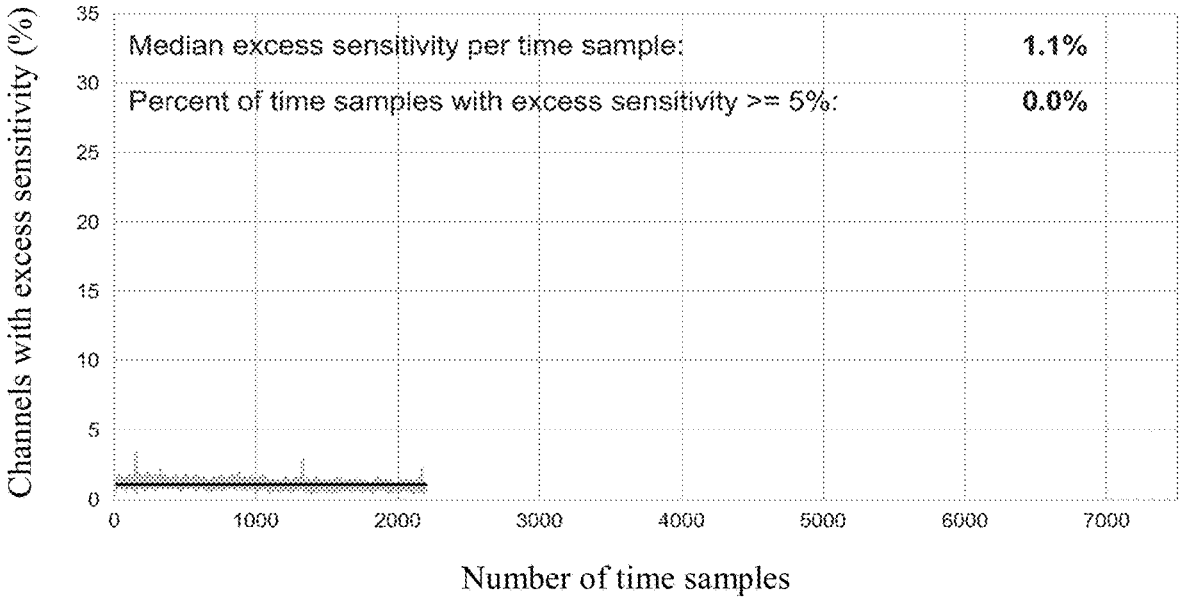
FIGS. 5A-5D illustrate graphs of sensitivity analysis of detected DAS data signals for different gauge lengths in a vertical section of a wellbore, in accordance with embodiments of the present disclosure.
Figure 5B:
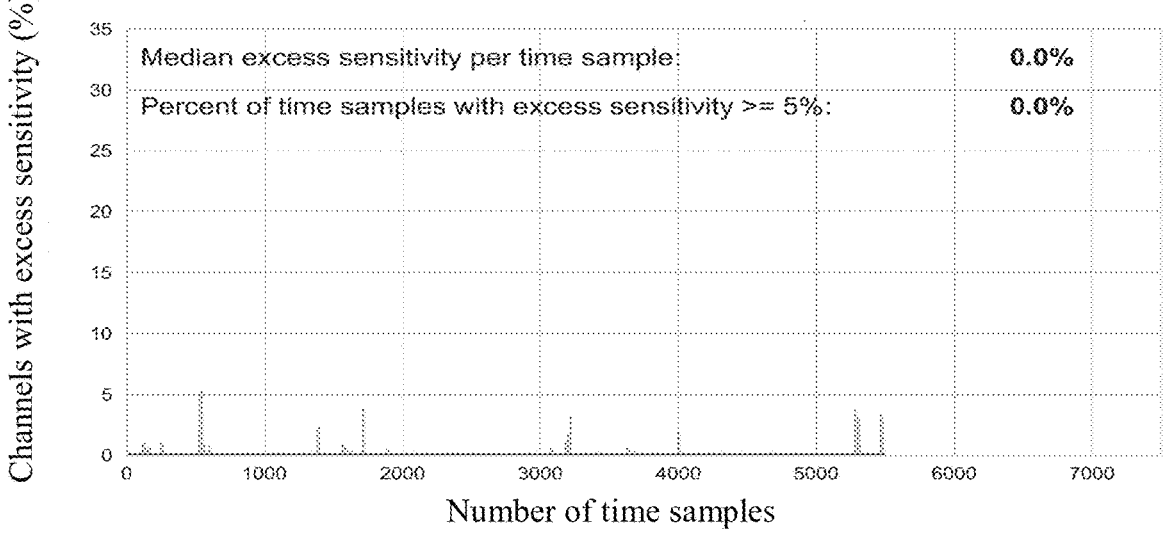

FIGS. 5A-5D illustrate sensitivity analysis across time samples and channels for different gauge lengths in an observation window in a vertical section of the wellbore, in accordance with embodiments of the present disclosure. FIGS. 5A-5B demonstrate the difference in sensitivity across time samples for 5 m vs. 15 m gauge lengths in the vertical section of the wellbore. The y-axis may represent the percent of channels with values in excess of the sensitivity threshold range and the x-axis may represent number of time samples. Here, a sensitivity threshold range may be set to (+/−) 0.005 μE, and signals may be statistically evaluated for measurements in excess of the sensitivity threshold range being set. A windowed approach in time may be utilized to identify the point time when the gauge length should be reevaluated due to the arrival of strain/fracture. In FIG. 5A, plot 500A depicts the percent of time samples with excess sensitivity across channels in an observation window for a gauge length of 5 m. It can be seen that the median excess sensitivity per time sample is 1.1%, and the percent of all time samples with excess sensitivity greater than or equal to 5% is zero for the 5 m gauge data. In FIG. 5B, plot 500B depicts the percent of time samples with excess sensitivity across channels in an observation window for a gauge length of 15 m. It can be seen that the median excess sensitivity across per time sample is 0.0%, and the percent of all time samples with excess sensitivity greater than or equal to 5% is 0.0% for 15 m gauge data. The values of strain evaluated statistically may represent actual strain or noise. As can be seen in comparison of FIG. 5A (5 m gauge) vs FIG. 5B (15 m gauge), the median excess sensitivity per time sample indicates the median time sample in the observation window is within the bounds of the sensitivity threshold, while the percent of time samples with excess sensitivity (across channels in the observation window, which may be >=5%) indicates there is higher signal or noise present in the 5 m gauge data in comparison to the 15 m gauge data. The percent of time samples with excess sensitivity across channels may be used to identify approaching strain or decreased SNR and trigger a reevaluation of gauge length.

Figure 5C:
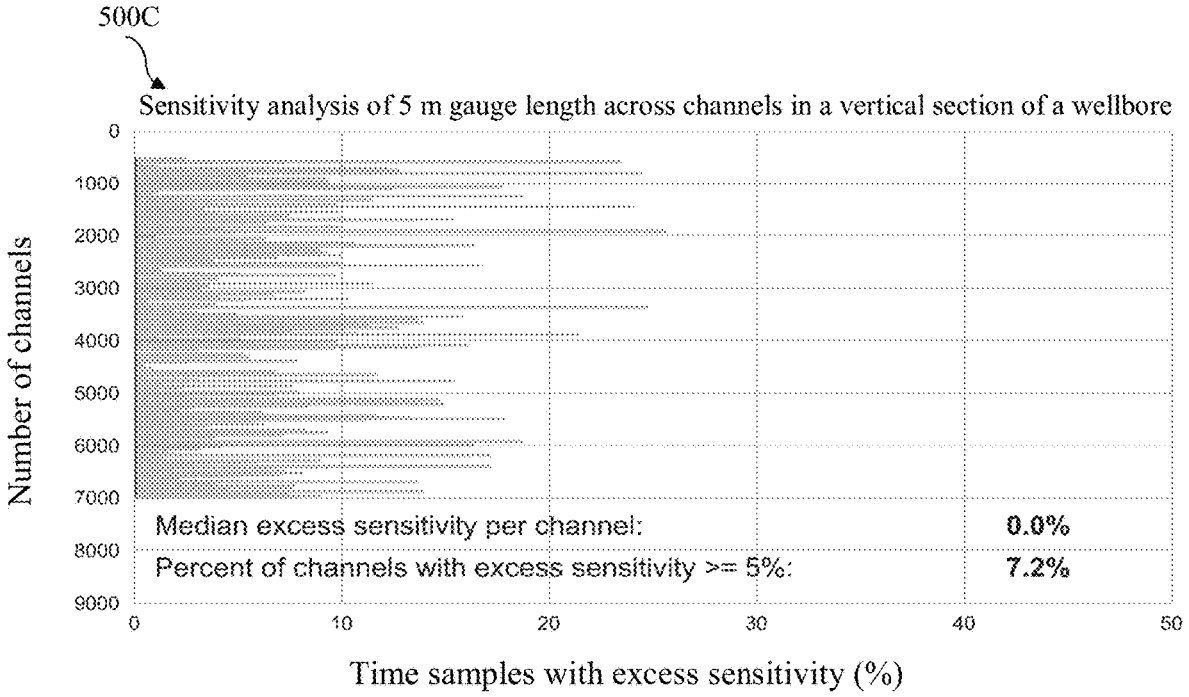
Figure 5D:
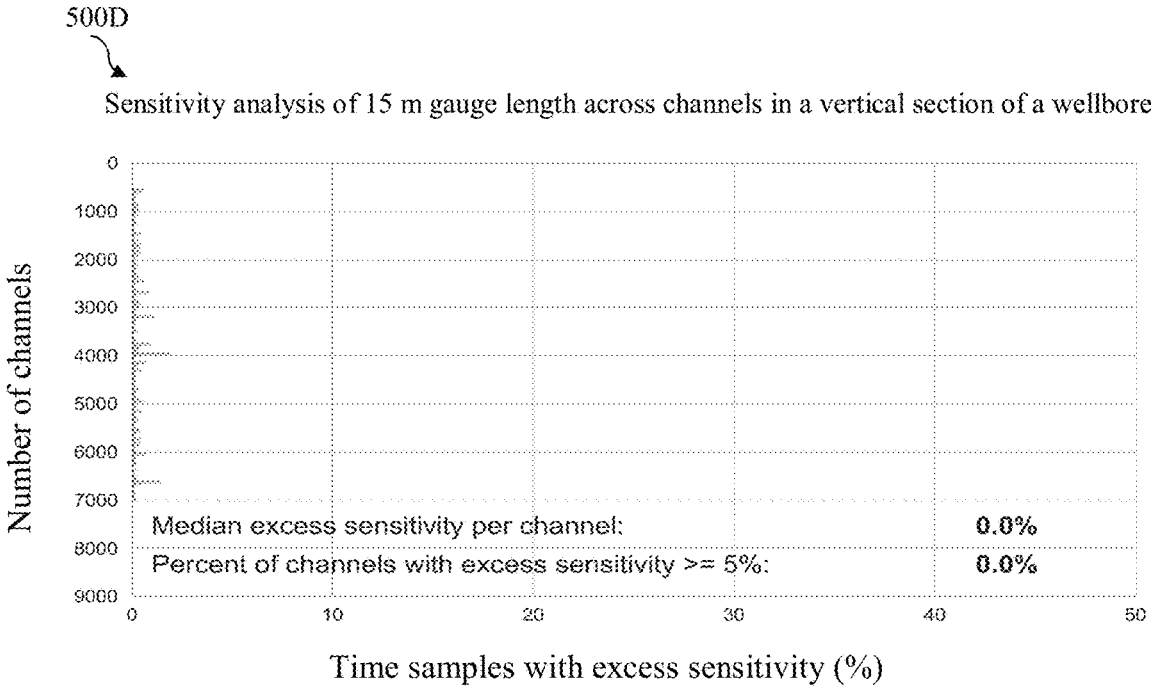

FIGS. 5C-5D illustrate median excess sensitivity across channels for different gauge lengths in a vertical section of a wellbore, in accordance with embodiments of the present disclosure. FIGS. 5C-5D demonstrate the difference in sensitivity across channels for 5 m vs. 15 m gauge lengths. Here, a sensitivity threshold range may be set to (+/−) 0.005

μE, and signals may be statistically evaluated for measurements in excess of the sensitivity threshold range being set. A windowed approach in channels may be utilized to identify the point time when the gauge length should be reevaluated due to the arrival of strain/fracture. In FIG. 5C, plot 500C depicts percent of channels with excess sensitivity across time samples in an observation window for a gauge length of 5 m. It can be seen that the median excess sensitivity per channel is 0.0%, and the percent of all channels with excess sensitivity greater than or equal to 5% is 7.2% for 5 m gauge data. In FIG. 5D, plot 500D depicts percent of channels with excess sensitivity across time samples in an observation window for a gauge length of 15 m. It can be seen that the median excess sensitivity per channel is 0.0%, and the percent of all channels with excess sensitivity greater than or equal to 5% is 0.0% for a gauge length of 15 m. The values of strain evaluated statistically may represent actual strain or noise. As can be seen in comparison of FIG. 5C (5 m gauge) vs FIG. 5D (15 m gauge), the median excess sensitivity per channel indicates the median channel in observation window is within the bounds of the sensitivity threshold, while the percent of observation channels with excess sensitivity (across time samples, which may be >=5%) indicates that there is higher signal or noise present in the 5 m gauge data in comparison to the 15 m gauge data. The percent of channels with excess sensitivity may be used to identify approaching strain or decreased SNR and trigger a reevaluation of gauge length.

Figure 6A:
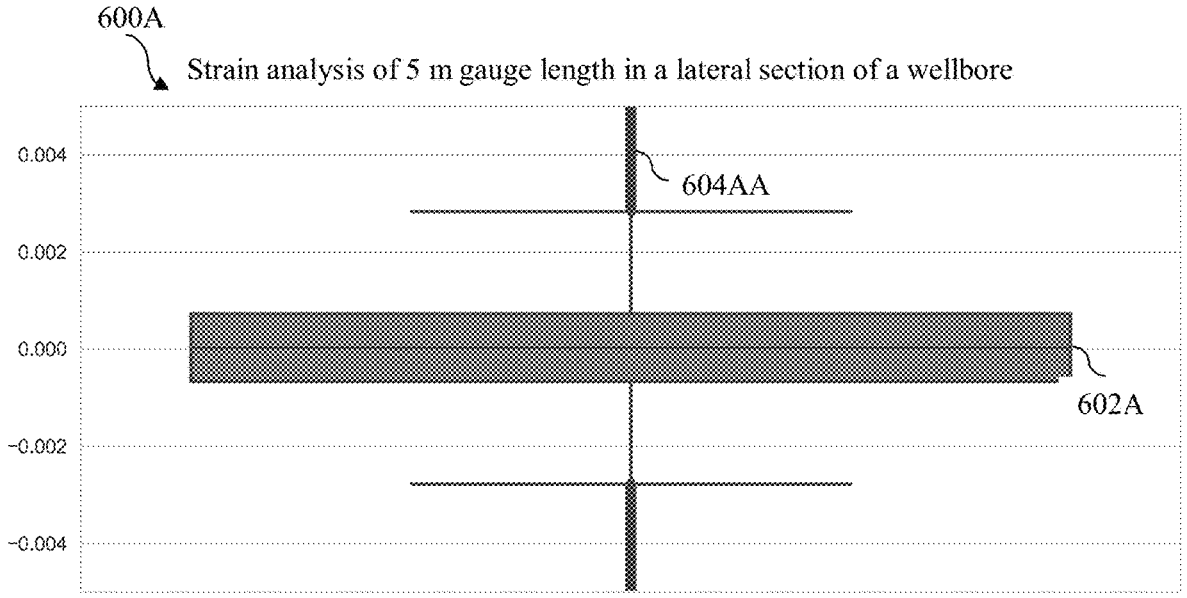
FIGS. 6A-6B illustrate boxplot graphs of strain analysis of detected DAS data signals or different gauge lengths in a lateral section of wellbore, in accordance with embodiments of the present disclosure.
Figure 6B:
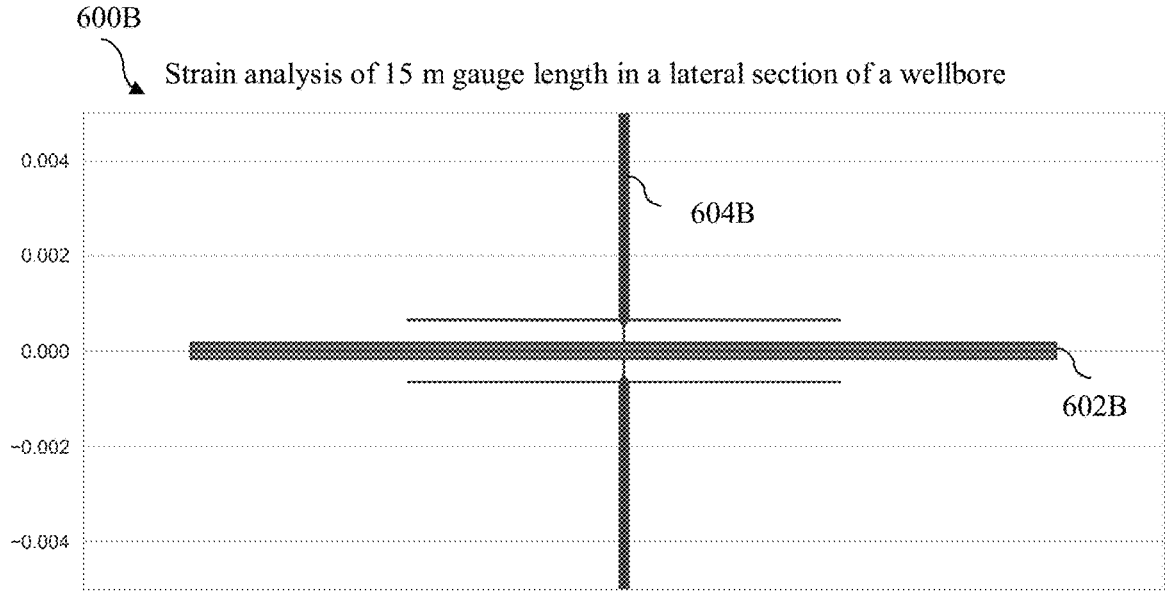

FIGS. 6A-6B illustrate boxplot graph of strain analysis for different gauge lengths across a lateral section of a wellbore, in accordance with embodiments of the present disclosure. FIG. 6A illustrates a boxplot graph 600A of strain analysis resulting using a gauge length of 5 m. In the boxplot, a center 602A may indicate the median value of strain. The straight lines above and below the box are the measured maximum strain and measured minimum strain values. The strain values that fall out of the minimum bound and maximum bound were identified as outliers 604A. FIG. 6B illustrates a boxplot graph 600B of strain analysis resulting using a gauge length of 15 m. In the boxplot, the center 602A indicates the median value of strain. The strain values that fall out of the minimum bound and maximum bound were identified as outliers 604B. As can be seen from FIG. 6A and FIG. 6B, in a comparison of the graph 600A (5 m gauge) vs. the graph 600B (15 m gauge), the strain or noise distribution in graph 600B (15 m gauge) has lower magnitude values and variance when compared to graph 600A (5 m gauge).

Figure 7A:
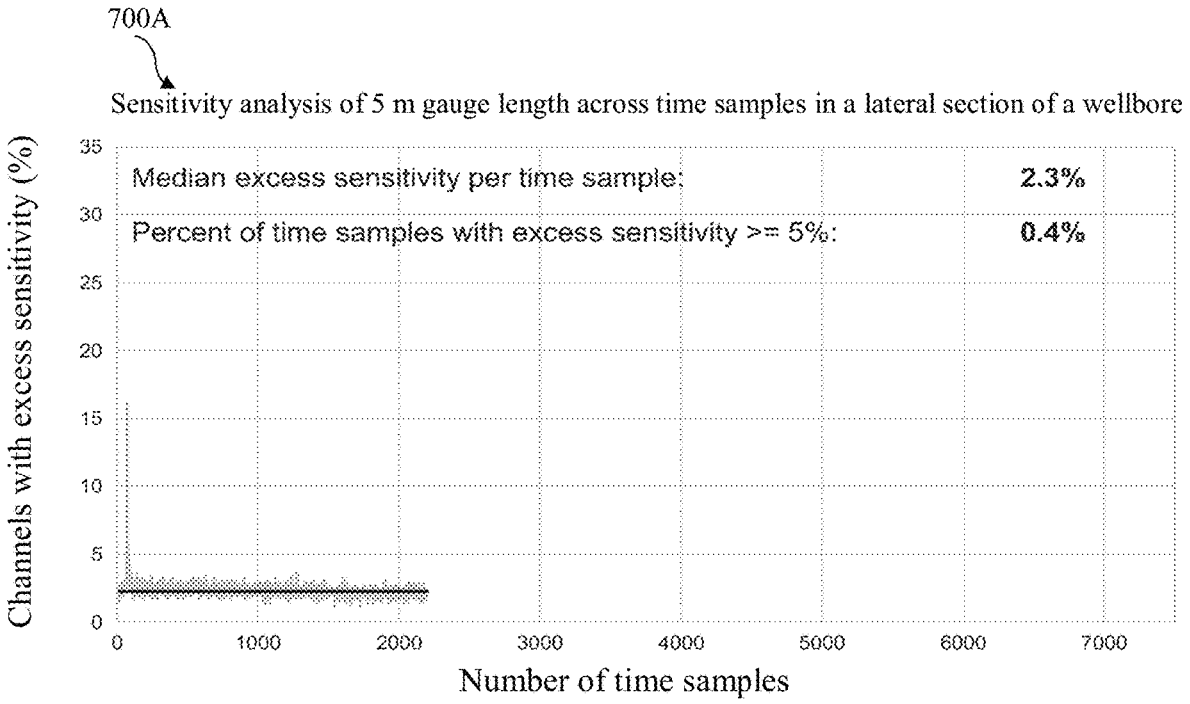
FIGS. 7A-7D illustrate graphs of sensitivity analysis of detected DAS data signals for different gauge lengths in a lateral section of a wellbore, in accordance with embodiments of the present disclosure.
Figure 7B:
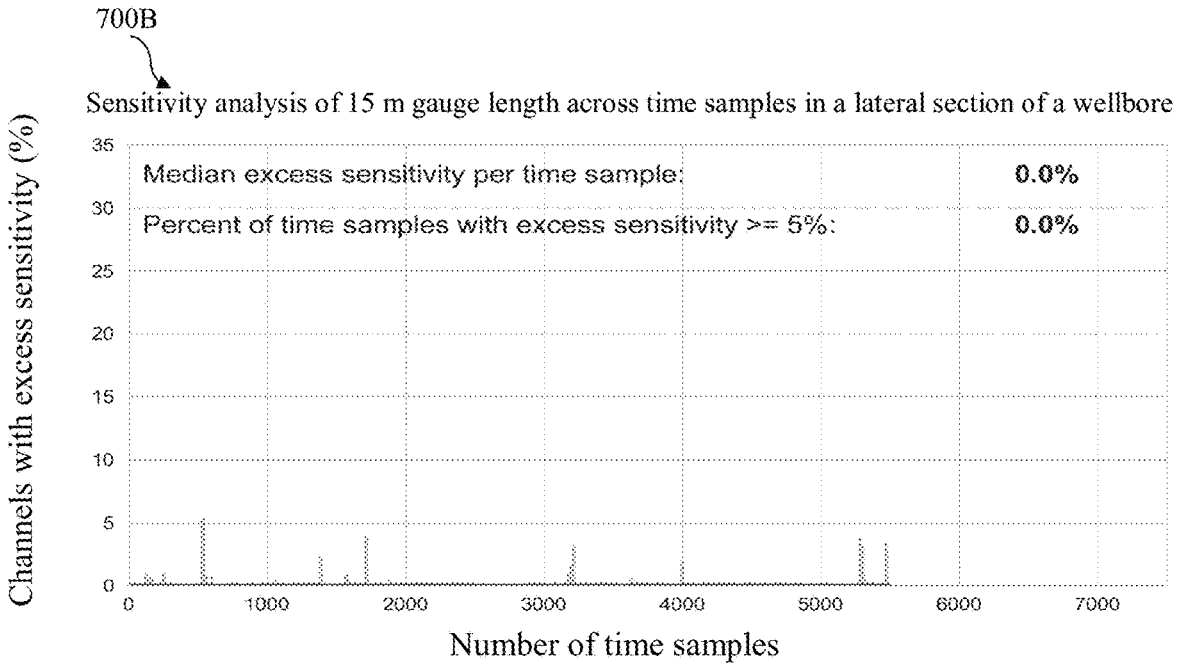

FIGS. 7A-7D illustrate sensitivity analysis for different gauge lengths in a lateral section of a wellbore, in accordance with embodiments of the present disclosure. FIGS. 7A-7B demonstrate the difference in sensitivity across time samples for 5 m vs. 15 m gauge lengths. Here, a sensitivity threshold range may set to (+/−) 0.005 μE, and signals may be statistically evaluated in excess of the sensitivity threshold range being set. A windowed approach in time may be utilized to identify the point time when the gauge length should be reevaluated due to the arrival of strain/fracture. In FIG. 7A, plot 700A depicts percent of time samples with excess sensitivity across channels in an observation window for a gauge length of 5 m. It can be seen that the median excess sensitivity per time sample is 2.3%, and the percent of all time samples with excess greater than or equal to 5% is 0.4% for 5 m gauge data. In FIG. 7B, plot 700B depicts percent of time samples with excess sensitivity across channels in an observation window for a gauge length of 15 m. It can be seen that the median excess sensitivity across per time sample is 0.0%, and the percent of all time samples with excess sensitivity greater than or equal to 5% is 0.0% for 15 m gauge data. The values of strain evaluated statistically may represent actual strain or noise. As can be seen in comparison of FIG. 7A (5 m gauge) vs. FIG. 7B (15 m gauge), the median excess sensitivity per time sample indicates the median time sample in observation window is within the bounds of the sensitivity threshold, while the percent of time samples with excess sensitivity (across channels in an observation window, which may be >=5%) indicates that there is higher signal or noise present in the 5 m gauge data in comparison to the 15 m gauge data. The percent of time samples with excess sensitivity across channels may be used to identify approaching strain or decreased SNR and trigger an evaluation of gauge length.

Figure 7C:
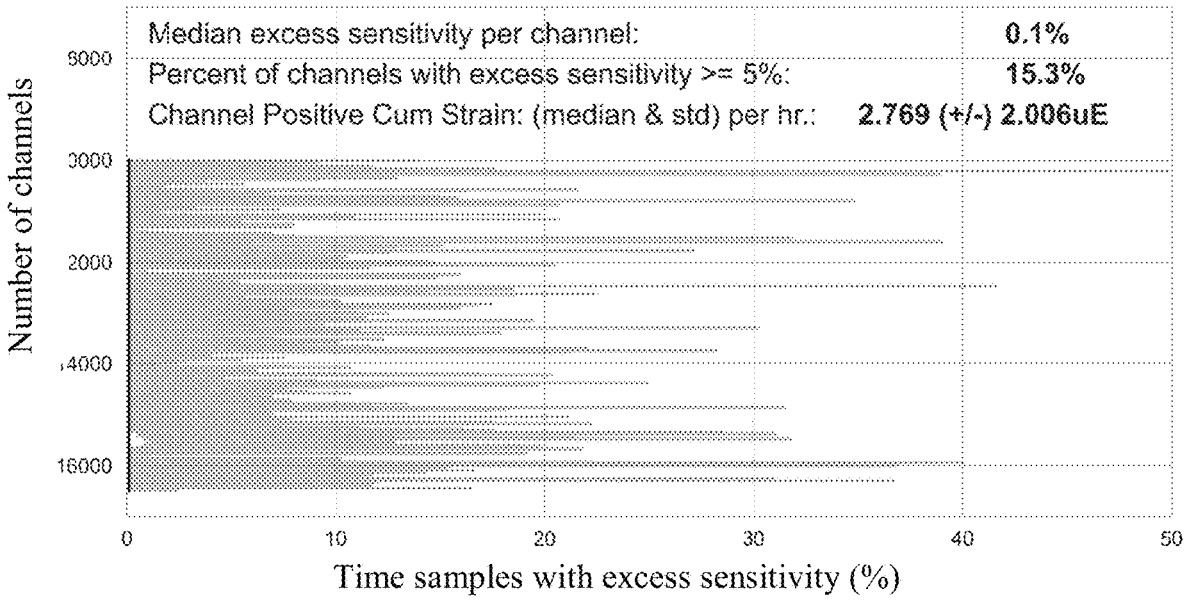
Figure 7D:
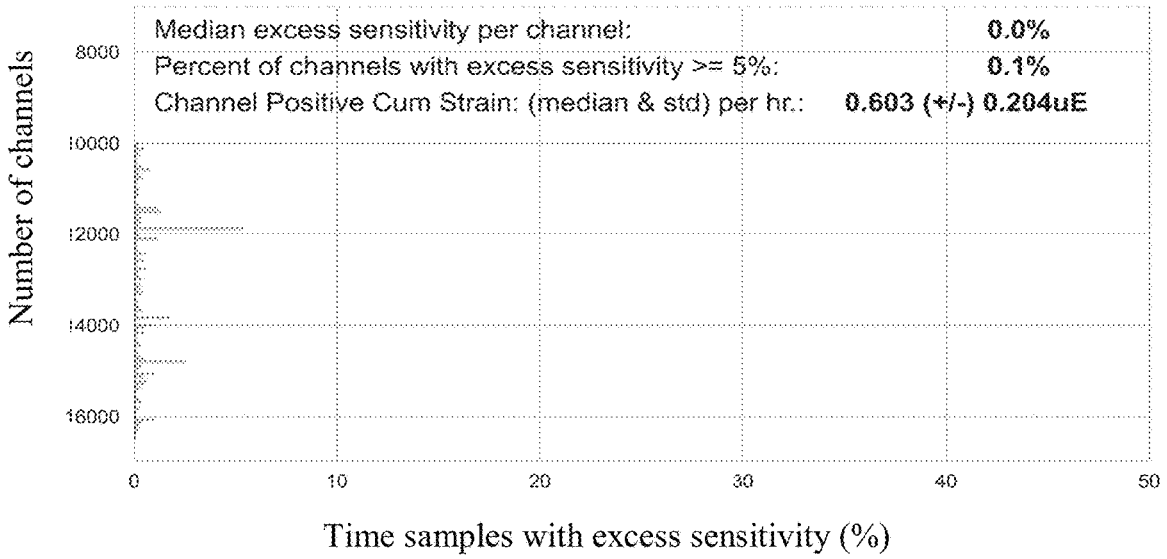

FIGS. 7C-7D illustrate median excess sensitivity percent across channels for different gauge lengths in lateral scale, in accordance with embodiments of the present disclosure. FIGS. 7C-7D demonstrate the difference in sensitivity across channels for 5 m vs. 15 m gauge lengths. Here, a sensitivity threshold range may be set to (+/−) 0.005 μE, and signals may be statistically evaluated in excess of the sensitivity threshold range being set. A windowed approach in channels may be utilized to identify the point time when the gauge length should be reevaluated due to the arrival of strain/fracture. In FIG. 7C, plot 700C depicts percent of channels with excess sensitivity across time samples in an observation window for a gauge length of 5 m. It can be seen that the median excess sensitivity per channel is 0.1%, and the percent of all channels with excess sensitivity greater than or equal to 5% is 15.3% for 5 m gauge data. In FIG. 7D, plot 700D depicts percent of channels with excess sensitivity across time samples in an observation window for a gauge length of 15 m. It can be seen that the median excess sensitivity per channel is 0.0%, and percent of time samples with excess sensitivity greater than or equal to 5% is 0.1% for 15 m gauge data. The values of strain evaluated statistically may represent actual strain or noise. As will be seen upon comparing FIG. 7C (5 m gauge) and FIG. 7D (15 m gauge), the median excess sensitivity per channel indicates the median channel in observation window is within the bounds of the sensitivity threshold, while the percent of observation channels with excess sensitivity (across time samples, which may be >=5%) indicates that there is higher signal or noise present in the 5 m gauge data in comparison to the 15 m gauge data. The percent of channels with excess sensitivity may be used to identify approaching strain or decreased SNR and trigger an evaluation of gauge length.

Further, median and standard deviation of cumulative strain per a specified unit time per channel may be calculated for 5 m vs. 15 m gauge lengths across a vertical or a lateral section of a wellbore. The median and standard deviation of cumulative strain per hour per channel have been observed as 2.679 (+/−) 2.006 μE for a gauge length of 5 m, and median and standard deviation of cumulative strain per hour per channel has been observed as 0.603 (+/−) 0.204 μE for a gauge length of 15 m. The values of strain evaluated statistically may represent actual strain or noise. As can be seen in comparison of FIG. 7C (5 m gauge) vs FIG. 7D (15 m gauge), the cumulative strain per a specified unit time per channel may vary depending on gauge length. A 5 m gauge length when compared to a 15 m gauge length may capture either more noise per channel or constrain real strain spatially creating a higher magnitude measurement. This statistics may be used to identify approaching strain or decreased SNR, and trigger a reevaluation of gauge length.

Figure 8:
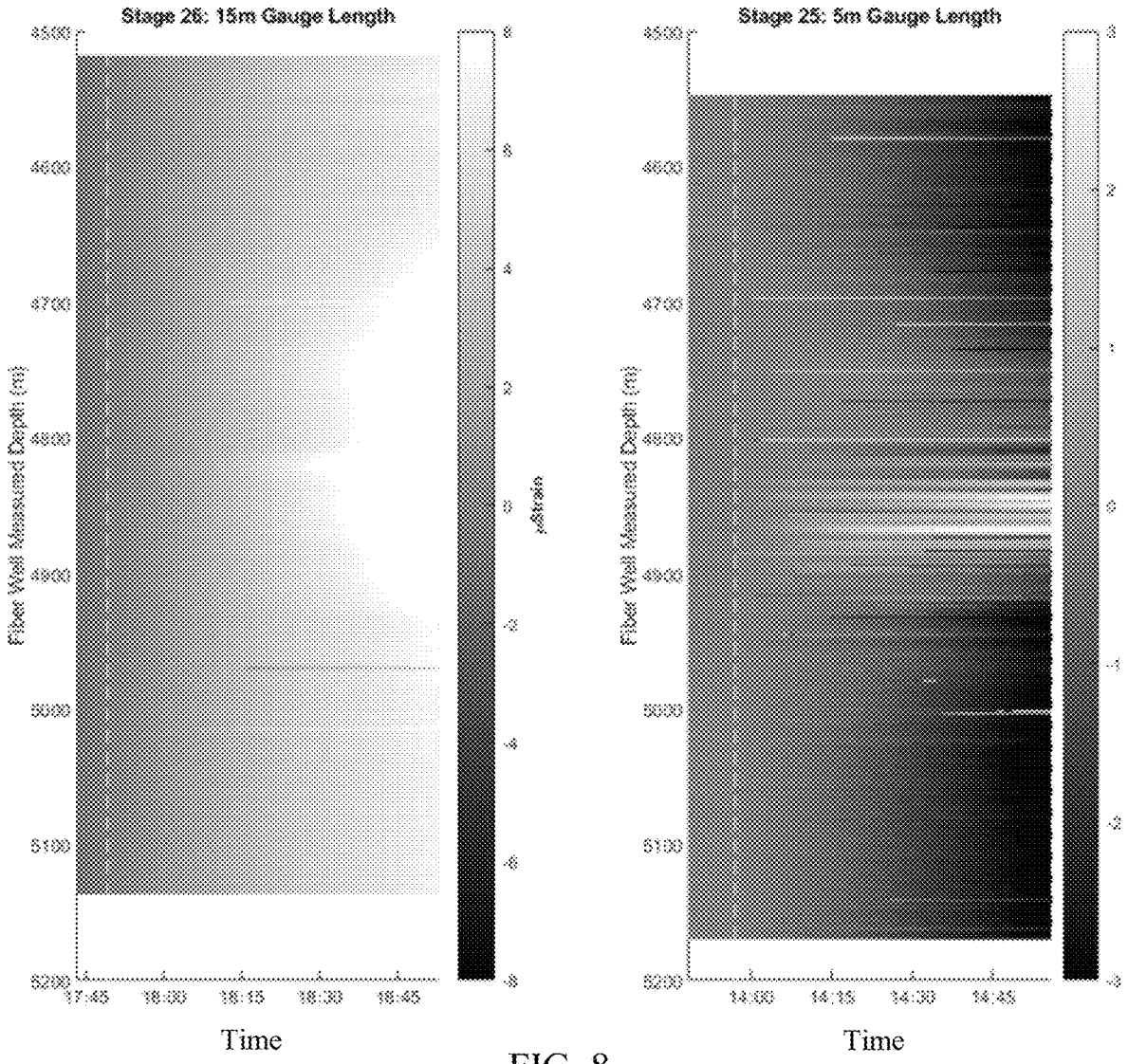
FIG. 8 illustrates graphs of detected DAS data signals measured with different gauge lengths across time and depth along the length of the optical fiber, in accordance with embodiments of the present disclosure.

FIG. 8 illustrates graphs 800 of noise and strain signals measured with 5 m vs. 15 m gauge lengths across time and depth along the length of the optical fiber, in accordance with embodiments of the present disclosure. As can be seen from the graphs, noise signals across channels are higher and SNR is less favorable for a smaller gauge length (i.e. a gauge length of 5 m). However, noise signals across channels are lower and SNR is more favorable for a higher gauge length (i.e. a gauge length of 15 m). Thus, depending on the location of the fracture, the location of the strain, the magnitude of noise across channels and time, or the magnitude of the real strain, it may be favorable to use either a smaller or a larger gauge length. When the fracture is distal and/or the magnitude of strain is low, the use of the larger gauge length may reduce noise across channels and improve SNR to detect the fracture/strain. However, spatial resolution is reduced when the fracture is near the DAS observation fiber well. When the fracture/strain is near the observation fiber, the magnitude of real strain may be significantly greater than the strain signal from noise, and it may be preferable to change gauge length to capture higher spatial resolution data. The use of statistics described herein may aid in the supervised learning of parameters to maximize both SNR and spatial resolution through the altering of the gauge length.

In an alternative embodiment, sensing DAS data may be acquired from multiple gauge lengths simultaneously or nearly simultaneously. As discussed in the disclosed methods, the DAS interrogator may continually switch among a set of gauge lengths, taking one measurement with each internal optical fiber. The data rate would be reduced for each additional gauge length added, but all of the data sets would be available. Thus, this alternative embodiment, the reflected signals may split into multiple internal fibers and make the measurements simultaneously such that an optimal gauge length measurement can be selected among the measured data sets. This may reduce artifacts uniquely inherent to each of the respective gauge lengths and provide an optimal measurement to dynamically adjust the gauge length. For example, the data associated with a relatively short gauge length (e.g., 5 m) and a relatively long gauge length (e.g., 40 m) may be averaged together. In some embodiments, weights may be applied to bias the combination toward a particular gauge length. For instance, more weight may be applied to the shorter gauge length data as compared to the longer gauge length data. These embodiments may require a fast acquisition rate for each of the selected gauge lengths, and the data may then be downsampled as needed for the various applications.

Figure 9:
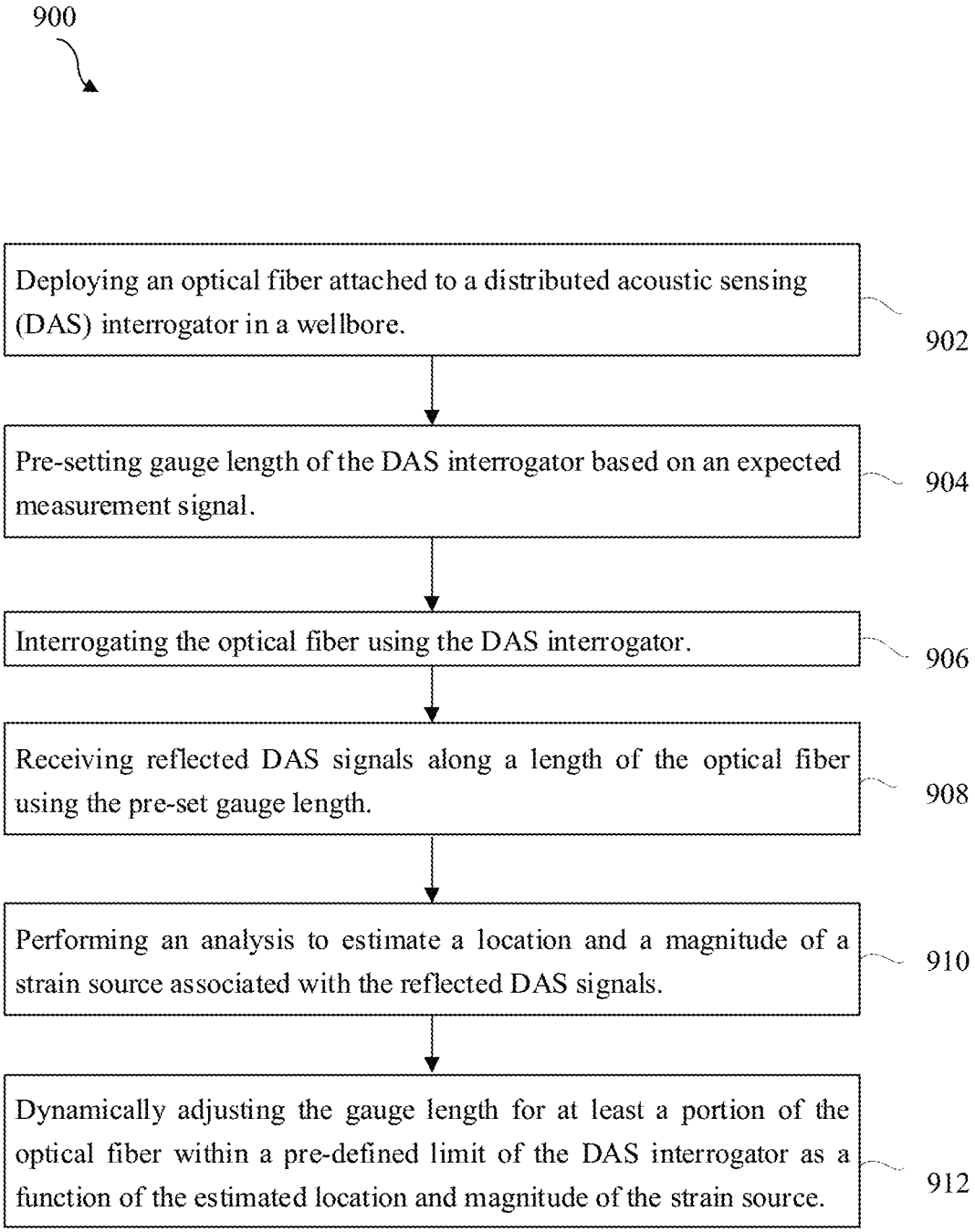
FIG. 9 illustrates a flow chart of a process to dynamically adjust a gauge length of a DAS interrogator, in accordance with embodiments of the present disclosure.

FIG. 9 illustrates a flow chart 900 of a method to dynamically adjust a gauge length of a DAS interrogator, in accordance with embodiments of the present disclosure. The method may begin at step 902 comprising deploying an optical fiber attached to the DAS interrogator in a wellbore. Step 904 may comprise pre-setting gauge length of the DAS interrogator based on an expected measurement signal. The expected measurement signal may comprise an expected wavelength of strain signals, an expected strain distribution along the optical fiber, or pre-estimated distance of a strain source from the optical fiber. The strain source may comprise one or more hydraulic fractures. Step 906 may comprise interrogating the optical fiber disposed in the wellbore with an optical signal using the DAS interrogator. In some embodiments, a laser generator with a certain frequency or multiple laser generators with preset frequencies intermittently emit optical signals, and the DAS interrogator together with the laser generators record the back-scattered/reflected DAS signals. Step 908 may comprise receiving the reflected DAS signals along the length of the optical fiber using the pre-set gauge length. The reflected DAS signals may be received from a set of measurement channels and/or over a period of time. In some cases, the reflected DAS signals are representative of one or more wellbore conditions, wherein the one or more wellbore conditions are selected from the group consisting of perforations, sensing acoustic signals during fracturing and in-flow stimulation, water injection, production monitoring, flow regimes, reflection seismic, micro-seismic, leaks, cross-flow, formation compaction, and combinations thereof. Step 910 may comprise performing an analysis, by a processor coupled to the DAS interrogator, to estimate a location and a magnitude of a strain source associated with the reflected DAS signals. Step 912 may comprise dynamically adjusting the gauge length of the DAS interrogator for at least a portion of the optical fiber within a pre-defined limit of the DAS interrogator as a function of the estimated location and magnitude of the strain source. The gauge length may be adjusted to enhance sensitivity and to optimize signal-to-noise ratio within the pre-defined limit of the DAS interrogator.

Figure 10:
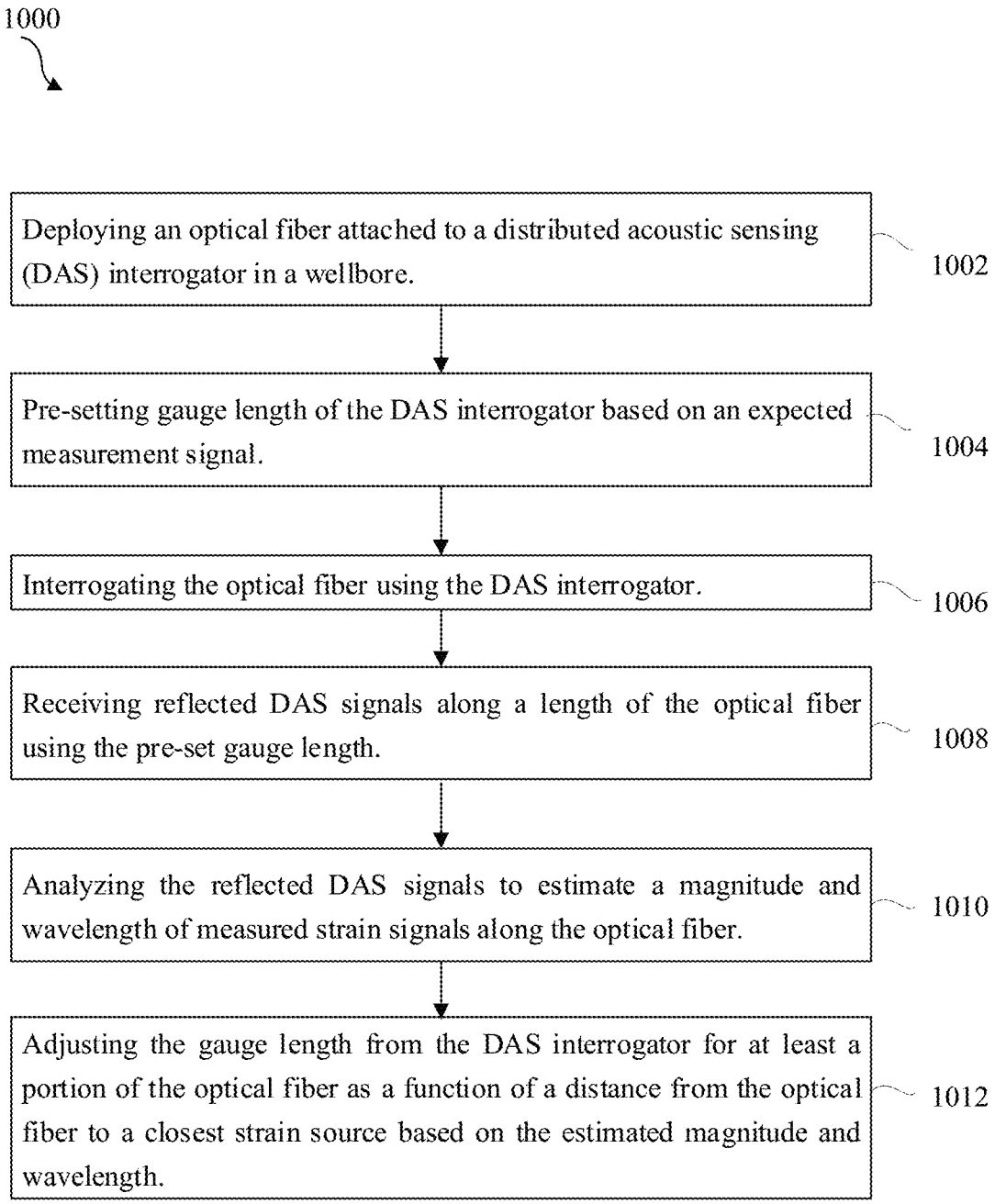
FIG. 10 illustrates another flow chart of a process to dynamically adjust a gauge length of a DAS interrogator, in accordance with embodiments of the present disclosure.

FIG. 10 illustrates a flow chart 1000 of a method to dynamically adjust a gauge length of a DAS interrogator using an external system, in accordance with embodiments of the present disclosure. The method may begin at step 1002 comprising deploying an optical fiber attached to the DAS interrogator in a wellbore. Step 1004 may comprise pre-setting gauge length of the DAS interrogator based on an expected measurement signal. The expected measurement signal may comprise an expected wavelength of strain signals, an expected strain distribution along the optical fiber, or pre-estimated distance of a strain source from the optical fiber. The strain source may comprise one or more hydraulic fractures. Step 1006 may comprise interrogating the optical fiber disposed in the wellbore with an optical signal using the DAS interrogator. Step 1008 may comprise receiving the reflected DAS signals along a length of the optical fiber using the pre-set gauge length. The reflected DAS signals may be received from a set of measurement channels and/or over a period of time. Step 1010 may comprise analyzing, by the external system (e.g., a processor), the reflected DAS signals to estimate the magnitude and wavelength of measured strain signals along the optical fiber. Step 1012 may comprise adjusting the gauge length from the DAS interrogator for at least a portion of the optical fiber as a function of a distance from the optical fiber to a closest strain source based on the estimated magnitude and wavelength. The gauge length may be adjusted within the pre-defined limit of the DAS interrogator to enhance sensitivity and to optimize signal-to-noise ratio within a pre-defined range.

Figure 11:
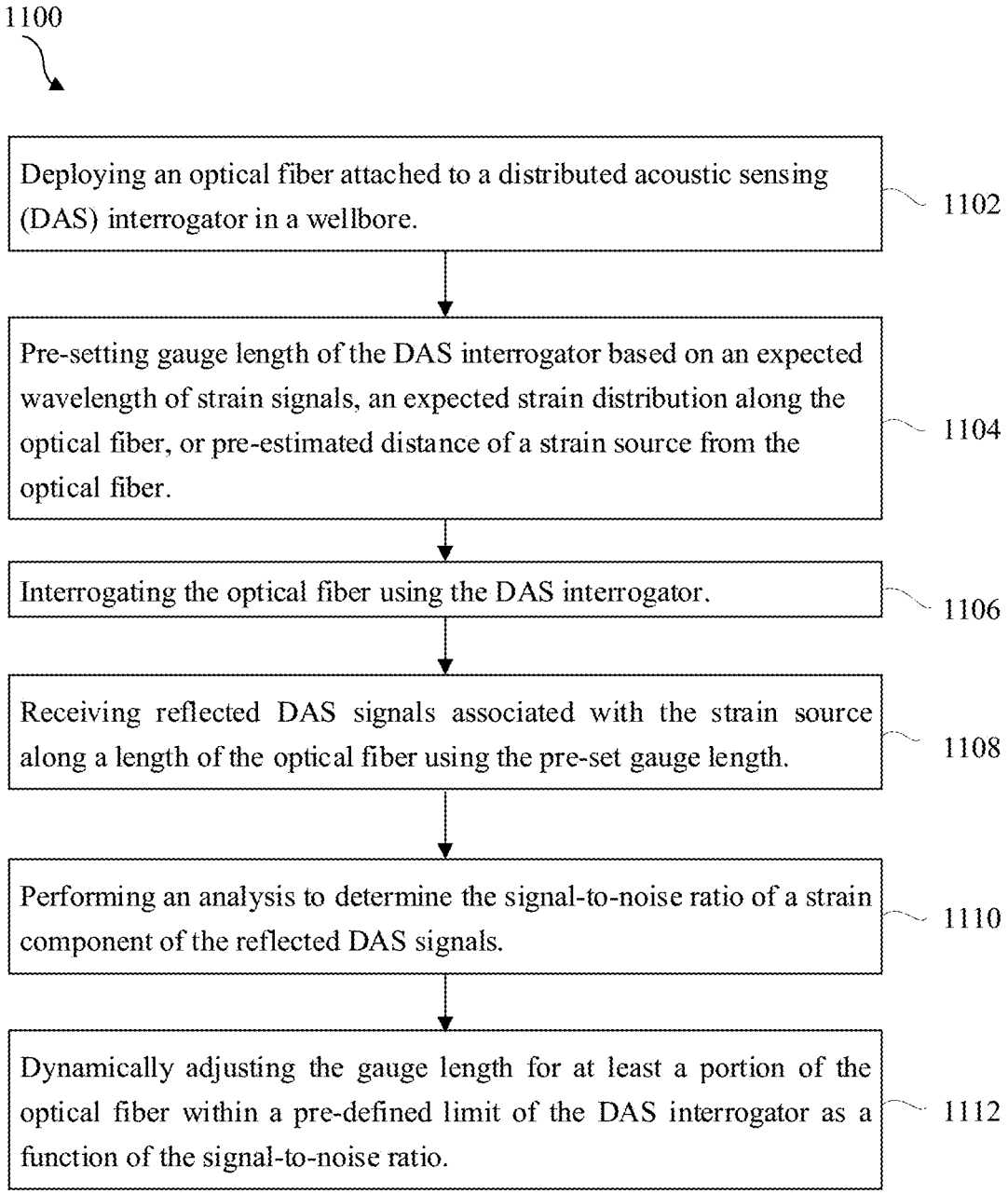
FIG. 11 illustrates another flow chart of a process to dynamically adjust a gauge length of a DAS interrogator, in accordance with embodiments of the present disclosure.

FIG. 11 illustrates a flow chart 1100 of a method to dynamically adjust a gauge length within the DAS interrogator, in accordance with embodiments of the present disclosure. The method may begin at step 1102 comprising deploying an optical fiber attached to the DAS interrogator in a wellbore. Step 1104 may comprise pre-setting gauge length of the DAS interrogator based on an expected measurement signal. The expected measurement signal may comprise an expected wavelength of strain signals, an expected strain distribution along the optical fiber, or pre-estimated distance of a strain source from the optical fiber. The strain source may comprise one or more hydraulic fractures. Step 1106 may comprise interrogating the optical fiber disposed in the wellbore with an optical signal using the DAS interrogator. Step 1108 may comprise receiving the reflected DAS signals along a length of the optical fiber using the pre-set gauge length. The reflected DAS signals associated with the strain source along the optical fiber may be received from a set of measurement channels and/or over a period of time. Step 1110 may comprise performing an analysis to determine the signal-to-noise ratio of a strain component of the reflected DAS signals. Step 1112 may comprise dynamically adjusting the gauge length for at least a portion of the optical fiber within a pre-defined limit of the DAS interrogator as a function of the signal-to-noise ratio. The gauge length may be adjusted to enhance sensitivity and to optimize the signal-to-noise ratio within the pre-defined limit of the DAS interrogator, wherein the signal-to-noise ratio calculation may be performed using a low-pass filter or Fast Fourier Transform (FFT).

In some alternative embodiments, in hydraulic fracturing operations, multiple sensors (e.g., pressure sensors) of the fiber optic line system may be positioned in either a treatment well or monitoring/observation well to measure well communication such as fracturing treatment pressures during a fracturing operation or measuring pressure in the monitoring well, where pressure changes may be an indication of approaching fluid fronts from the treatment well. Thus, the fracturing spread parameters (such as well pressure, fracturing fluid flow rate, proppant concentration, diverters, fluids, and chemicals) may be adjusted to change the hydraulic fracturing treatment. The disclosed methods may be employed, for example, in hydraulic fracturing operations, to enable real-time monitoring across channels and/or time of the DAS data, and to dynamically adjust gauge length early in the fracture growth stage based on the monitored data. This may allow for the highest sensitivity for measurement of weak signals, the maximizing of the SNR, and a higher resolution of subsurface monitoring for hydraulic fracturing operations including one or more of DAS micro-seismic, distributed strain sensing applications, and distributed temperature sensing applications.

Figure 12:
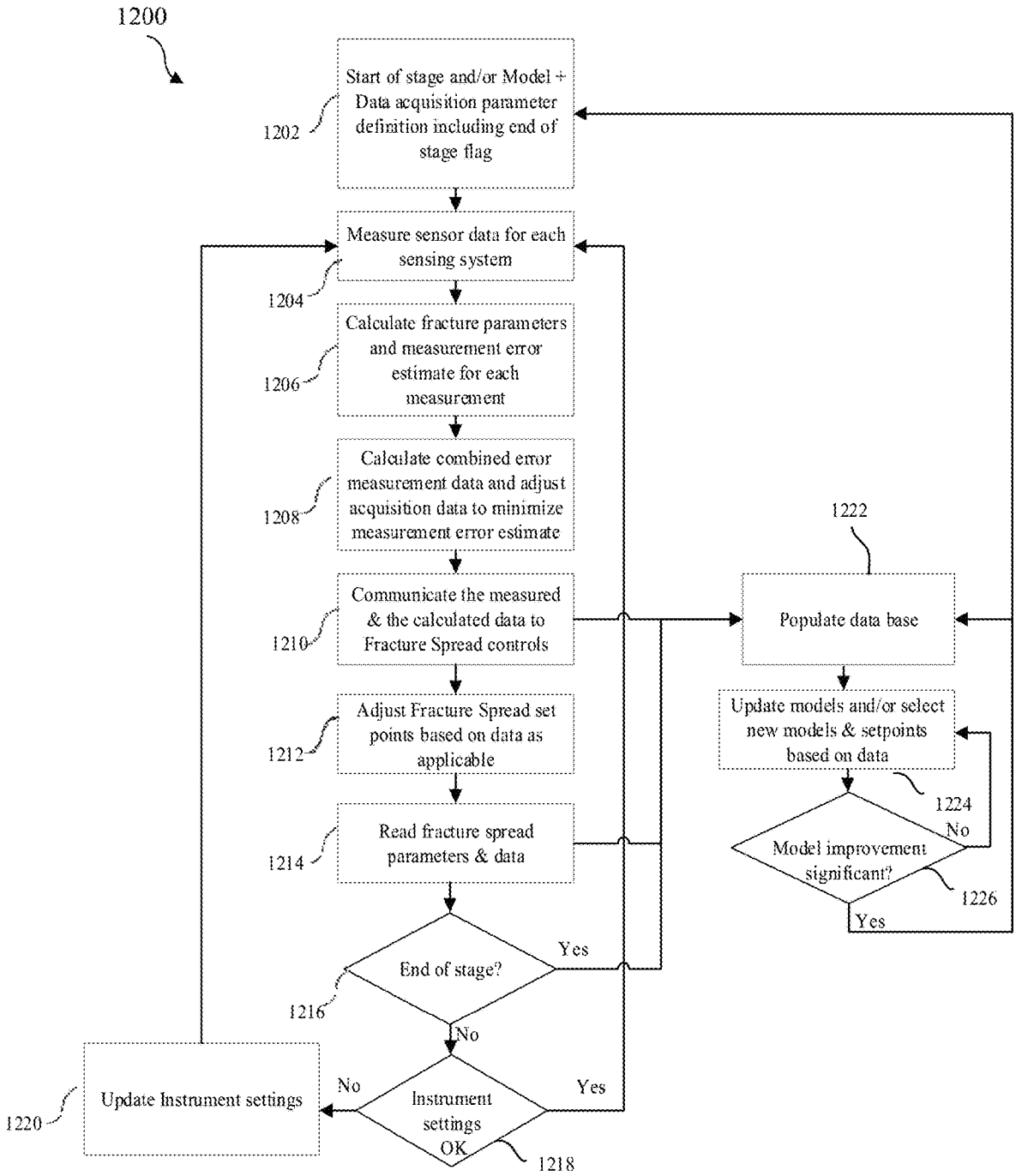
FIG. 12 illustrates a flow chart of a process to dynamically adjust a gauge length of a DAS interrogator to optimize hydraulic fracturing treatment using one or more sensing systems, in accordance with embodiments of the present disclosure.

FIG. 12 illustrates a flow chart 1200 of a method to dynamically adjust a gauge length of a DAS interrogator to optimize hydraulic fracturing treatment using one or more sensing systems, in accordance with embodiments of the present disclosure. Some embodiments described herein are directed to centralized and distributed control of one or more of multiple sensing systems (e.g., pressure sensing systems, distributed acoustic sensing systems, distributed strain sensing systems, distributed temperature sensing systems) deployed along a wellbore using a model associated with one or more of a supervisory controller and/or centralized computer system. The centralized computer system may allow for intelligent control of sensors to change measurement instrument settings for optimized measurements to feed models in order to adjust the fracturing spread set points during a fracturing operation, to enable optimization in a treatment well, and optionally to measure e.g. pressure in a monitoring well, where pressure changes may be an indication of approaching fluid fronts from the treatment well. The supervisory controller may provide multiple sensor inputs to the model, where the combined optimized output may be used to control the fracturing operations to meet fracture fluid placement goals of the wellbore, reservoir and well system. The model may comprise a machine learning model, a data driven model, a physics based model, or a hybrid model.

The method 1200 may begin by deploying one or more sensing systems in one or more subterranean wells, wherein the subterranean wells may comprise monitoring wells or hydraulic fracturing wells. Step 1202 may comprise start fracturing a first stage or a first time period of a fracturing stage of the hydraulic fracturing well using pre-determined acquisition data including a flag that indicates an end stage. In some cases, a model may also be defined using pre-determined acquisition data. Step 1204 may comprise measuring sensor data for each sensing system based on the pre-determined acquisition data. The one or more sensing systems may comprise a distributed fiber optic sensing cable configured to transmit optical signals through the one or more subterranean wells and transmit backscattered optical signals. The sensing systems may further be selected from the group consisting of a distributed acoustic sensing (DAS) system, a distributed temperature sensing (DTS) system, a distributed strain sensing (DSS) system, or a pressure sensing system. Step 1206 may comprise determining fracturing parameters (such as fracture orientation, fracture length, fracture height, and/or fracture width) and measurement error estimate for each measurement of the one or more sensing systems based on the measured sensor data. As each sensing system may have a measurement error and individual measurements with large measurement errors may be assigned a small weight or small contribution to the overall measurement accuracy. Thus, combining each individual measurement errors may minimize/optimize a system level error. Step 1208 may comprise calculating a combined measurement error term and adjusting acquisition data to minimize/optimize the measurement error estimate and to improve the quality of the measured data. In some embodiments, step 1210 may comprise communicating the measured sensor data, the measured error data, and the calculated combined error measurement data to a supervisory controller, wherein the data may be used in fracturing models/equipment and fracturing spread controls. In optional step 1212, an optional supervisory controller may adjust the fracturing spread set points based on one or more models running on the supervisory controller associated with the sensing systems, wherein the model comprises a machine learning model, a data driven model, a physics based model, or a hybrid model. The method 1200 describes a fracture property measurement system that may or may not include supervisory fracturing spread controls. The fracturing spread setpoints may comprise fracturing fluid flow rate, pumping pressure, proppant concentration (ppg of proppant), chemical composition, friction reducers etc. Step 1222 may comprise populating a database in communication with the supervisory controller and step 1224 may comprise updating the model or selecting a new model based on the measurement data. Step 1226 may comprise determining whether the improvement in the model is significant. If improvement in the model is significant, the method may return to step 1222 or step 1202. Otherwise, the method may return to step 1224. Step 1214 may comprise reading the fracture spread set points, parameters, and measurement data from other data sources to collect a complete data set for model development in case a supervisory fracturing system control system and other data sources are outside the process flow outlined in method 1200. Step 1216 may comprise determining whether the first stage has reached an end to enable appropriate end of stage processes. If the first stage has reached to the end, the method may return to step 1222. Otherwise, the method may further comprise determining whether instrument settings are satisfactory at step 1218. If the method determines that the instruments settings are not satisfactory, the method may proceed to updating the instrument settings at step 1220 and return to step 1204 for fracturing a subsequent stage.

In various embodiments, a non-transitory machine-readable storage device can comprise instructions stored thereon, which, when performed by a machine, cause the machine to perform operations, the operations comprising one or more features similar to or identical to features of methods and techniques described with respect to method 900, method 1000, method 1100, method 1200, variations thereof, and/or features of other methods taught herein such as associated with FIGS. 1-12. The physical structures of such instructions may be operated on by one or more processors. For example, executing these physical structures can cause the processor to perform operations with respect to method 900, method 1000, method 1100, method 1200, variations thereof, and/or features of other methods taught herein such as associated with FIGS. 1-12. Execution of various instructions may be realized by the control circuitry of the machine to execute one or more features similar to or identical to features of methods and techniques described with respect to method 900, method 1000, method 1100, method 1200, variations thereof, and/or features of other methods taught herein such as associated with FIGS. 1-12. For example, the instructions can include instructions to operate a tool or tools having a laser generator and interrogator disposed with respect to an optical fiber in a wellbore to provide data to process in accordance with the teachings herein.

Figure 13:
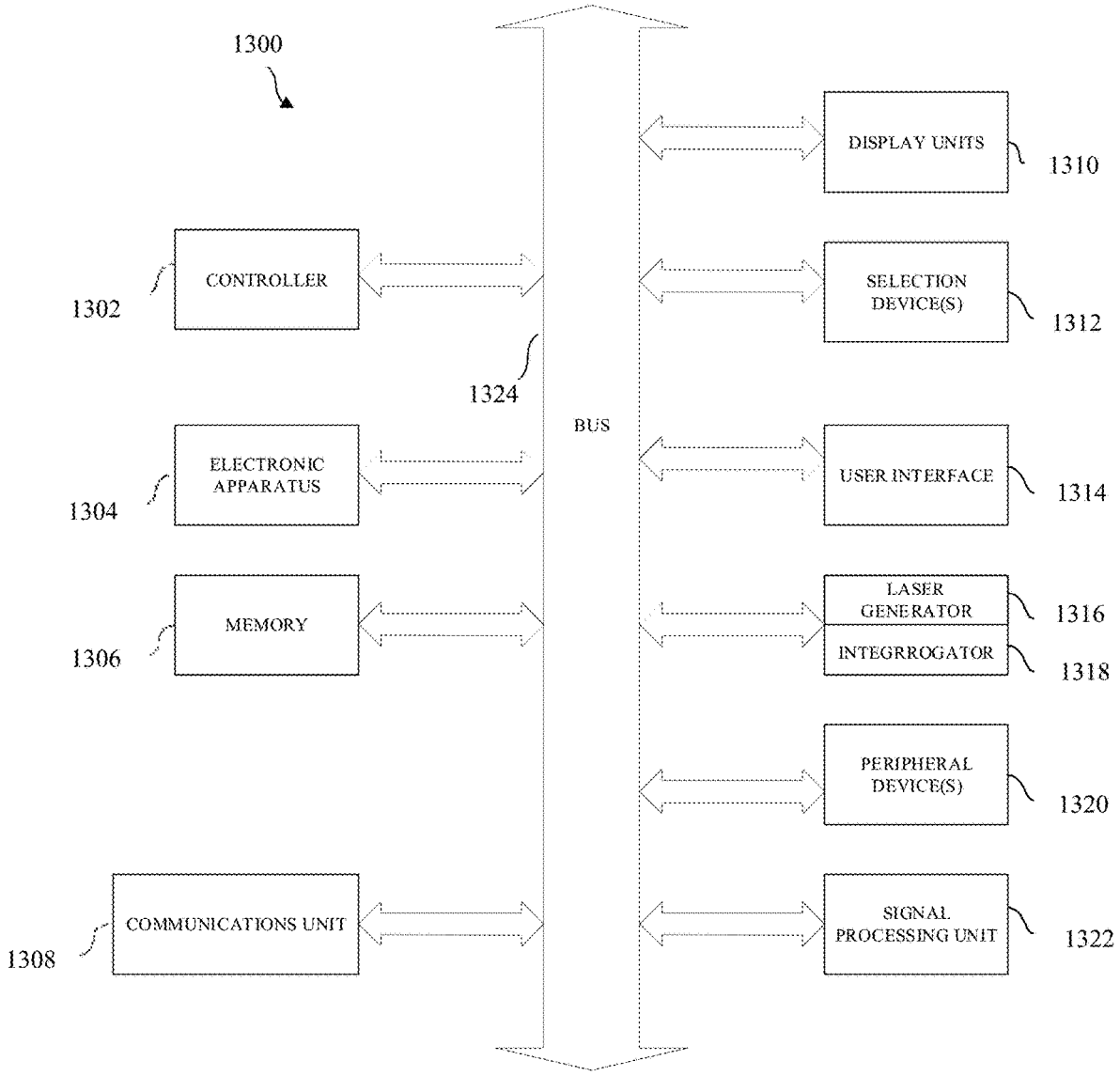
FIG. 13 is a block diagram of features of an example system operable to execute schemes associated with gauge length adjustment with respect to optical measurements in a wellbore, in accordance with embodiments of the present disclosure.

FIG. 13 is a block diagram of features of an embodiment of an example system 1300 operable to execute schemes associated with adjusting the gauge length effect with respect to optical measurements in a wellbore. The system 1300 can comprise instrumentality as taught herein, for example, in accordance with embodiments described with respect to FIG. 1-12 or similar arrangements and their operation as taught herein.

The system 1300 may comprise a controller(s) 1302, one or more laser generators 1316, and one or more interrogators 1318. The controller(s) 1320 may be arranged to control the one or more laser generators 1316 and the one or more interrogators 1318. The controller(s) 1302 may be arranged to process data from optical signals received by the interrogator 1318, where the optical signals are from regions of the wellbore, in response to optical signals coupled into an optical fiber by the laser generator(s) 1316 with the optical fiber disposed in the wellbore generated to determine status of structures and material within the wellbore and/or the formation around the wellbore. The controller(s) 1302 may be operable to process optical signals in accordance with features of features similar to or identical to features of methods and techniques described with respect to method 900, method 1000, method 1100, method 1200, variations thereof, and/or features of other methods taught herein such as associated with FIGS. 1-12. The controller(s) 1302 can be realized as one or more processors. The controller(s) 1302 may be arranged as a single processor or a group of processors. Processors of the group of processors may operate independently depending on an assigned function. The controller(s) 1302 may be realized as one or more application-specific integrated circuits (ASICs). The controller(s) 1302 may be realized as control circuitry to manage the components of system 1300.

The interrogator 1318 may be realized by different optical sensors and/or optical processing devices. For example, the interrogator can include one of more interferometric systems. The laser generator(s) 1316 may include one or more lasers. The one or more lasers may be operable at selected laser frequencies.

The system 1300 may include a user interface 1314 operable with the controller(s) 1302, a signal processing unit 1322 operable with the user interface 1314, where the controller(s) 1302, the user interface 1314, and the signal processing unit 1322 may be structured to be operated according to any scheme similar to or identical to the schemes associated with adjusting the gauge length with respect to optical measurements in a wellbore as taught herein. The system 1300 can be arranged as a distributed system.

The system 1300 may include a memory 1306, an electronic apparatus 1304, and a communications unit 1308. The controller(s) 1302, the memory 1306, and the communications unit 1308 may be arranged to operate as a signal processing unit to control investigation of a wellbore, pipe structure in the wellbore, material in the wellbore, and formation around the wellbore. The memory 1306 may be realized as a memory module, which may include a set of memory devices and access devices to interface with the set of memory devices. The memory 1306 may include a database having information and other data such that the system 1300 may operate on data to control the laser generator(s) 1316 and the interrogator 1318. In an embodiment, the signal processing unit 1322 may be distributed among the components of the system 1300 including memory 1306 and/or the electronic apparatus 1304. Alternatively, the signal processing unit 1322 may be arranged as an independent system having its own processor(s) and memory. The electronic apparatus 1304 may include drivers to provide voltage and/or current input to components of the system 1300. For example, the electronic apparatus 1304 may include drivers of optical sources, such as lasers, and can include electronic circuitry for optical detectors and interferometric devices associated with optical fiber receiver arrangements.

The communications unit 1308 may use combinations of wired communication technologies and wireless technologies at appropriate frequencies. The communications unit 1308 may allow for a portion or all of data analysis regarding the status of the strain sources to be provided to the user interface 1314 for presentation on the one or more display unit(s) 1310 aboveground. The communications unit 1308 may allow for transmission of commands to downhole components in response to signals provided by a user through the user interface 1314.

The system 1300 can also include a bus 1324, where the bus 1324 provides electrical conductivity among the components of the system 1300. The bus 1324 may include an address bus, a data bus, and a control bus, each independently configured. The bus 1324 may be realized using a number of different communication mediums that allows for the distribution of components of the system 1300. Use of the bus 1324 may be regulated by the controller(s) 1302. The bus 1324 may include a communications network to transmit and receive signals including data signals and command and control signals. In a distributed architecture, the bus 1324 may be part of a communications network.

In various embodiments, peripheral devices 1320 may include additional storage memory and/or other control devices that may operate in conjunction with the controllers(s) 1302 and/or the memory 1306. The display unit(s) 1310 can be arranged with a screen display as a distributed component that can be used with instructions stored in the memory 1306 to implement the user interface 1314 to manage the operation of the one or more laser generators 1316, one or more interrogators 1318, and/or components distributed within the system 1300. Such a user interface may be operated in conjunction with the communications unit 1308 and the bus 1324. The display unit(s)

1310 may include a video screen, a printing device, or other structure to visually project data/information and images. The system 1300 may include a number of selection devices 1312 operable with the user interface 1314 to provide user inputs to operate the signal processing unit 1322 or its equivalent. The selection device(s) 1312 may include one or more of a touch screen, a computer mouse, or other control device operable with the user interface 1314 to provide user inputs to operate the signal processing unit 1322 or other components of the system 1300.

ADDITIONAL DISCLOSURE

The following are non-limiting, specific embodiments in accordance with the present disclosure:

A first embodiment, which is a method, comprising deploying an optical fiber attached to a distributed acoustic sensing (DAS) interrogator in a wellbore, pre-setting gauge length of the DAS interrogator based on an expected measurement signal, interrogating the optical fiber using the DAS interrogator, receiving reflected DAS signals along a length of the optical fiber using the pre-set gauge length, performing, by a processor, an analysis to estimate a location and a magnitude of a strain source associated with the reflected DAS signals, and dynamically adjusting the gauge length of the DAS interrogator for at least a portion of the optical fiber within a pre-defined limit of the DAS interrogator as a function of the estimated location and magnitude of the strain source.

A second embodiment, which is the method of the first embodiment, wherein the DAS interrogator is configured with a plurality of optical fibers to obtain measurements using a plurality of gauge lengths and employs an optical switch to select a desired length optical fiber among the optical fibers to adjust the gauge length based on the analysis.

A third embodiment, which is the method of any of the first and the second embodiments, wherein the processor is coupled to the DAS interrogator and configured to command the DAS interrogator to select the desired length optical fiber to adjust the gauge length based on the analysis.

A fourth embodiment, which is the method of any of the first through the third embodiments, wherein the expected measurement signal comprises an expected wavelength of strain signals, an expected strain distribution along the optical fiber, or pre-estimated distance of a strain source from the optical fiber, and wherein the strain source comprises one or more hydraulic fractures.

A fifth embodiment, which is the method of any of the first through the fourth embodiments, further comprising performing an analysis using a linear inversion of the reflected DAS signals together with a predictive model of signals from hydraulic fracture growth to estimate a distance of the one or more strain sources from the fiber and/or the location along the fiber.

A sixth embodiment, which is the method of any of the first through the fifth embodiments, wherein the receiving comprises receiving the reflected DAS signals from a set of measurement channels and/or over a period of time along the length of the optical fiber.

A seventh embodiment, which is the method of any of the first through the sixth embodiments, wherein the gauge length is adjusted to enhance sensitivity and to optimize signal-to-noise ratio within the pre-defined limit of the DAS interrogator.

An eighth embodiment, which is the method of any of the first through the seventh embodiments, further comprising analyzing, by the processor, the reflected DAS signals to estimate the magnitude and wavelength of measured strain signals along the optical fiber; and adjusting the gauge length from the DAS interrogator for at least a portion of the optical fiber as a function of a distance from the optical fiber to a closest strain source based on the estimated magnitude and wavelength.

A ninth embodiment, which is the method of any of the first through the eighth embodiments, wherein the estimated wavelength is the lowest wavelength of the reflected DAS signals along the length of the optical fiber A tenth embodiment, which is the method of any of the first through the ninth embodiments, further comprising obtaining DAS data associated with different gauge lengths simultaneously such that an optimal gauge length measurement can be selected among measured data sets.

An eleventh embodiment, which is the method of any of the first through the tenth embodiments, wherein the reflected DAS signals are representative of one or more wellbore conditions, wherein the one or more wellbore conditions are selected from the group consisting of perforations, sensing acoustic signals during fracturing and inflow stimulation, water injection, production monitoring, flow regimes, reflection seismic, micro-seismic, leaks, cross-flow, formation compaction, and combinations thereof.

A twelfth embodiment, which is a method implemented by a distributed acoustic sensing (DAS) interrogator, comprising deploying an optical fiber attached to the DAS interrogator in a wellbore, pre-setting gauge length of the DAS interrogator based on an expected wavelength of strain signals, an expected distribution of the strain signals along the optical fiber, or pre-estimated distance of a strain source from the optical fiber, interrogating the optical fiber using DAS interrogator, receiving reflected DAS signals associated with the strain source along a length of the optical fiber using the pre-set gauge length, performing an analysis to determine the signal-to-noise ratio of a strain component of the reflected DAS signals, and dynamically adjusting the gauge length for at least a portion of the optical fiber within a pre-defined limit of the DAS interrogator as a function of the signal-to-noise ratio.

A thirteenth embodiment, which is the method of the twelfth embodiment, wherein the DAS interrogator is configured with a plurality of optical fibers to obtain measurements using a plurality of gauge lengths and employs an optical switch to select a desired length optical fiber among the optical fibers to adjust the gauge length based on the analysis.

A fourteenth embodiment, which is the method of any of the twelfth and the thirteenth embodiments, wherein the receiving comprises receiving the reflected DAS signals from a set of measurement channels and/or over a period of time along the length of the optical fiber.

A fifteenth embodiment, which is the method of any of the twelfth through the fourteenth embodiments, wherein the gauge length is adjusted to enhance sensitivity and to optimize signal-to-noise ratio within the pre-defined limit of the DAS interrogator, and wherein the signal-to-noise ratio calculation is performed using a low-pass filter or Fast Fourier Transform (FFT).

A sixteenth embodiment, which is a method, comprising deploying the one or more sensing systems in one or more subterranean wells, wherein the subterranean wells comprise monitoring wells or hydraulic fracturing wells, fracturing a first stage of a hydraulic fracturing well using pre-determined acquisition data, measuring sensor data for each sensing system based on the pre-determined acquisition data, determining fracturing parameters and measurement error estimate for each measurement of the one or more sensing systems based on the measured sensor data, calculating a combined error measurement data and adjusting acquisition data to minimize the measurement error estimate; and communicating the measured sensor data and the calculated combined error measurement data to a supervisory controller in order to adjust fracturing spread set points during the fracturing treatment.

A seventeenth embodiment, which is the method of the sixteenth embodiment, wherein the one or more sensing systems comprise a distributed acoustic sensing (DAS) system, a distributed temperature sensing (DTS) system, a distributed strain sensing (DSS) system, or a pressure sensing system, and wherein the measurement data comprises at least one of temperature data, acoustic data, vibration data, pressure data, strain data, or combinations thereof.

An eighteenth embodiment, which is the method of any of the sixteenth and the seventeenth embodiments, wherein the one or more sensing systems comprise a distributed fiber optic sensing cable configured to transmit optical signals through the one or more subterranean wells and transmit backscattered optical signals.

A nineteenth embodiment, which is the method of any of the sixteenth through the eighteenth embodiments, the fracturing parameters comprise fracture orientation, fracture length, fracture height, and/or fracture width.

A twentieth embodiment, which is the method of any of the sixteenth through the nineteenth embodiments, further comprising generating the fracturing spread set points by a model running on the supervisory controller based on the data, wherein the model comprises a machine learning model, a data driven model, a physics based model, or a hybrid model.

A twenty-first embodiment, which is the method of any of the sixteenth through the twentieth embodiments, further comprising populating a database in communication with the supervisory controller, and updating the model or selecting a new model based on the measurement data.

A twenty-second embodiment, which is the method of any of the sixteenth through the twenty-first embodiments, further comprising determining whether the first stage has reached to an end, checking settings of the one or more sensing systems in response to the determination that the stage has not reached to the end, and updating the settings of the one or more sensing systems to start a subsequent stage.

A twenty-third embodiment, which is a method, comprising deploying a distributed fiber optic cable connected with the sensing system in one or more subterranean wells, wherein the subterranean wells comprise monitoring wells or hydraulic fracturing wells, determining a preliminary gauge length of the sensing system based on preliminary strain threshold range, receiving reflected strain signals associated with a strain source along the fiber optic cable, detecting a current strain threshold range of the reflected strain signals associated with the strain source, determining whether the current strain threshold range has changed from the preliminary strain threshold range, and adjusting the gauge length for at least a portion of the optical fiber within a pre-defined limit of the sensing system in response to the determination that current strain threshold range has changed from the preliminary strain threshold range.

A twenty-fourth embodiment, which is the method of the twenty-third embodiment, wherein detecting the current strain threshold range comprises calculating a cumulative strain magnitude across expected DAS channels over a predetermined time window along the fiber optic cable.

A twenty-fifth embodiment, which is the method of any of the twenty-third and the twenty-fourth embodiments, wherein the sensing system is configured to detect the perturbations along the distributed fiber optic cable, and wherein the strain source comprises one or more hydraulic fractures.

A twenty-sixth embodiment, which is the system, comprising a distributed acoustic sensing (DAS) system comprising a DAS interrogator coupled to at least one optical fiber deployed within a wellbore and configured to pre-set gauge length based on an expected measurement signal, interrogate the optical fiber, and receive reflected DAS signals along a length of the optical fiber using the pre-set gauge length, and a processor coupled to the DAS system and configured to perform an analysis to estimate a location and a magnitude of a strain source associated with the reflected DAS signals, wherein the DAS interrogator is further configured to dynamically adjust the gauge length for at least a portion of the optical fiber within a pre-defined limit of the DAS interrogator as a function of the estimated location and magnitude of the strain source.

A twenty-seventh embodiment, which is the system of the twenty-sixth embodiment, wherein the processor is further configured to analyze the reflected DAS signals to estimate the magnitude and wavelength of measured strain signals along the optical fiber, and wherein the DAS interrogator is further configured to adjust the gauge length from the DAS interrogator for at least a portion of the optical fiber as a function of a distance from the optical fiber to a closest strain source based on the estimated magnitude and wavelength.

A twenty-eighth embodiment, which is the system any of the twenty-sixth and the twenty-seventh embodiments, wherein the DAS interrogator is further configured with a plurality of optical fibers to obtain measurements using a plurality of gauge lengths and employs an optical switch to select a desired length optical fiber among the optical fibers to adjust the gauge length.

A twenty-ninth embodiment, which is the system any of the twenty-sixth through the twenty-eighth embodiments, wherein the processor is further configured to command the DAS interrogator to select the desired length optical fiber to adjust the gauge length based on the analysis.

A thirtieth embodiment, which is the system any of the twenty-sixth through the twenty-ninth, wherein the expected measurement signal comprises an expected wavelength of strain signals, an expected strain distribution along the optical fiber, or pre-estimated distance of a strain source from the optical fiber, and wherein the strain source comprises one or more hydraulic fractures.

A thirty-one embodiment, which is the system any of the twenty-sixth through the thirtieth embodiments, wherein the estimated wavelength is the lowest wavelength of the reflected DAS signals along the length of the optical fiber.

A thirty-second embodiment, which is the system any of the thirtieth through the thirty-one embodiments, wherein the gauge length is adjusted to enhance sensitivity and to optimize signal-to-noise ratio within the pre-defined limit of the DAS interrogator.

A thirty-third embodiment, which is a system, comprising a distributed acoustic sensing (DAS) interrogator coupled to at least one optical fiber deployed within a wellbore and configured to pre-set gauge length of the DAS interrogator based on an expected wavelength of strain signals, an expected distribution of the strain signals along the optical fiber, or pre-estimated distance of a strain source from the optical fiber, interrogate the optical fiber, receive reflected DAS signals associated with the strain source along a length of the optical fiber using the pre-set gauge length, perform an analysis to determine the signal-to-noise ratio of a strain component of the reflected DAS signals, and dynamically adjust the gauge length for at least a portion of the optical fiber within a pre-defined limit of the DAS interrogator as a function of the signal-to-noise ratio.

A thirty-fourth embodiment, which is the system of the thirty-third embodiment further configured with a plurality of optical fibers to obtain measurements using a plurality of gauge lengths and employs an optical switch to select a desired length optical fiber among the optical fibers to adjust the gauge length.

A thirty-fifth embodiment, which is the system of any of the thirty-third and thirty-fourth embodiments, wherein the gauge length is adjusted to enhance sensitivity and to optimize signal-to-noise ratio within the pre-defined limit of the DAS interrogator, and wherein the signal-to-noise ratio calculation is performed using a low-pass filter or Fast Fourier Transform (FFT).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Use of the term "optionally" with respect to any element of a claim is intended to mean that the subject element may be present in some embodiments and not present in other embodiments. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of this disclosure. Thus, the claims are a further description and are an addition to the embodiments of this disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A method comprising:

deploying an optical fiber attached to a distributed acoustic sensing (DAS) interrogator in a wellbore;

pre-setting gauge length of the DAS interrogator based on an expected measurement signal;

interrogating the optical fiber using the DAS interrogator;

receiving reflected DAS signals along a length of the optical fiber using the pre-set gauge length;

performing, by a processor, an analysis to estimate a magnitude of a strain source associated with the reflected DAS signals and wavelength of measured strain signals along the optical fiber; and dynamically adjusting the gauge length for at least a portion of the optical fiber within a pre-defined limit of the DAS interrogator as a function of a distance from the optical fiber to a closest strain source based on the estimated magnitude and wavelength.

2. The method of claim 1, wherein the DAS interrogator is configured with a plurality of optical fibers to obtain measurements using a plurality of gauge lengths and employs an optical switch to select a desired length optical fiber among the optical fibers to adjust the gauge length.

3. The method of claim 2, wherein the processor is coupled to the DAS interrogator and configured to command the DAS interrogator to select the desired length optical fiber to adjust the gauge length based on the analysis.

4. The method of claim 1, wherein the expected measurement signal comprises an expected wavelength of strain signals, an expected strain distribution along the optical fiber, or pre-estimated distance of a strain source from the optical fiber, and wherein the strain source comprises one or more hydraulic fractures.

5. The method of claim 1, wherein the receiving comprises receiving the reflected DAS signals from a set of measurement channels and/or over a period of time along the length of the optical fiber.

6. The method of claim 1, wherein the gauge length is adjusted to enhance sensitivity and to optimize signal-to-noise ratio within the pre-defined limit of the DAS interrogator.

7. The method of claim 1, wherein the estimated wavelength is the lowest wavelength of the reflected DAS signals along the length of the optical fiber.

8. The method of claim 1, further comprising obtaining DAS data associated with different gauge lengths simultaneously such that an optimal gauge length measurement can be selected among measured data sets.

9. The method of claim 1, wherein the reflected DAS signals are representative of one or more wellbore conditions, wherein the one or more wellbore conditions are selected from the group consisting of perforations, sensing acoustic signals during fracturing and in-flow stimulation, water injection, production monitoring, flow regimes, reflection seismic, micro-seismic, leaks, cross-flow, formation compaction, and combinations thereof.

10. A method implemented by a distributed acoustic sensing (DAS) interrogator comprising:

deploying an optical fiber attached to the DAS interrogator in a wellbore;

pre-setting gauge length of the DAS interrogator based an expected wavelength of strain signals, an expected strain distribution along the optical fiber, or pre-estimated distance of a strain source from the optical fiber;

interrogating the optical fiber using DAS interrogator;

receiving reflected DAS signals associated with the strain source along a length of the optical fiber using the pre-set gauge length;

performing an analysis to determine signal-to-noise ratio of a strain component associated with the reflected DAS signals, wherein the analysis is performed using a linear inversion of the reflected DAS signals together with a predictive model of signals from hydraulic fracture growth; and dynamically adjusting the gauge length for at least a portion of the optical fiber within a pre-defined limit of the DAS interrogator as a function of the signal-to-noise ratio.

11. The method of claim 10, wherein the DAS interrogator is configured with a plurality of optical fibers to obtain measurements using a plurality of gauge lengths and employs an optical switch to select a desired length optical fiber among the optical fibers to adjust the gauge length based on the analysis.

12. The method of claim 10, wherein the receiving comprises receiving the reflected DAS signals from a set of measurement channels and/or over a period of time along the length of the optical fiber.

13. The method of claim 10, wherein the gauge length is adjusted to enhance sensitivity and to optimize signal-to-noise ratio within the pre-defined limit of the DAS interrogator, and wherein the signal-to-noise ratio calculation is performed using a low-pass filter or Fast Fourier Transform (FFT).

14. A method of optimizing a fracturing treatment using a sensing system, the method comprising:

deploying a distributed fiber optic cable connected with the sensing system in one or more subterranean wells, wherein the subterranean wells comprise monitoring wells or hydraulic fracturing wells;

determining a preliminary gauge length of the sensing system based on preliminary strain threshold range;

receiving reflected strain signals associated with a strain source along the fiber optic cable;

detecting a current strain threshold range of the reflected strain signals associated with the strain source;

determining whether the current strain threshold range has changed from the preliminary strain threshold range; and adjusting the gauge length for at least a portion of the optical fiber within a pre-defined limit of the sensing system in response to the determination that current strain threshold range has changed from the preliminary strain threshold range.

15. The method of claim 14, wherein detecting the current strain threshold range comprises calculating a cumulative strain magnitude across expected DAS channels over a predetermined time window along the fiber optic cable.

16. The method of claim 14, wherein the sensing system is configured to detect perturbations along the distributed fiber optic cable, and wherein the strain source comprises one or more hydraulic fractures.

* * * * *